US009339709B2

(12) United States Patent
Lagier et al.

(10) Patent No.: US 9,339,709 B2
(45) Date of Patent: May 17, 2016

(54) GUIDE ARM MACHINE

(71) Applicants: Les Lagier, Santa Clara, CA (US); Thomas J Burns, Campbell, CA (US); Jerome A Johnson, Monte Sereno, CA (US)

(72) Inventors: Les Lagier, Santa Clara, CA (US); Thomas J Burns, Campbell, CA (US); Jerome A Johnson, Monte Sereno, CA (US)

( * ) Notice: Subject to any disclaimer, the term of this patent is extended or adjusted under 35 U.S.C. 154(b) by 0 days.

(21) Appl. No.: 14/455,905

(22) Filed: Aug. 9, 2014

(65) Prior Publication Data

US 2016/0038811 A1 Feb. 11, 2016

(51) Int. Cl.

| | |
|---|---|
| ***A63B 69/00*** | (2006.01) |
| ***A63B 69/36*** | (2006.01) |
| *A63B 21/00* | (2006.01) |
| *A63B 23/035* | (2006.01) |
| *A63B 21/008* | (2006.01) |
| *A63B 21/06* | (2006.01) |

(52) U.S. Cl.

CPC ..... *A63B 69/00* (2013.01); *A63B 69/0002* (2013.01); *A63B 69/3632* (2013.01); *A63B 21/00069* (2013.01); *A63B 21/0081* (2013.01); *A63B 21/0611* (2013.01); *A63B 21/1488* (2013.01); *A63B 23/03516* (2013.01); *A63B 69/0091* (2013.01); *A63B 69/365* (2013.01); *A63B 69/3644* (2013.01); *A63B 2069/0006* (2013.01); *A63B 2069/0008* (2013.01); *A63B 2243/007* (2013.01); *A63B 2243/0008* (2013.01)

(58) Field of Classification Search

CPC ..... A63B 69/0091; A63B 69/0002; A63B 69/3644; A63B 21/0125; A63B 21/1488; A63B 23/03516; A63B 21/00069; A63B 69/365; A63B 21/0081; A63B 21/0611

USPC ..... 473/422, 453, 461, 229, 212, 223, 451, 473/428; D21/789

See application file for complete search history.

(56) References Cited

U.S. PATENT DOCUMENTS

| | | | | |
|---|---|---|---|---|
| 2,472,065 A * | 6/1949 | Cottingham | ..... | A63B 21/015 473/229 |
| 2,985,482 A | 5/1961 | Trippet | | |
| 3,429,571 A * | 2/1969 | Abel | ..... | A63B 69/365 473/229 |
| 3,937,464 A | 2/1976 | Zalewski | | |
| 5,087,039 A | 2/1992 | Laeeke | | |
| 5,156,402 A | 10/1992 | Hart | | |

(Continued)

FOREIGN PATENT DOCUMENTS

WO WO 2005/009544 A2 2/2005

*Primary Examiner* — Mitra Aryanpour
(74) *Attorney, Agent, or Firm* — Douglas L. Weller

(57) ABSTRACT

A guide arm machine includes a guide arm and an equipment holder attached to the guide arm. The equipment holder is optimized to hold a sports equipment item. The guide arm is attached to a shaft so that the shaft defines a rotation axis around which the guide arm rotates. An adjustable main beam whose position is adjustable with respect to a stationary anchor, so that when the sports equipment item is held by the equipment holder and a position of the adjustable main beam is appropriately adjusted, rotation of the guide arm around the guide arm guides an athlete holding the equipment holder item into a desired motion that trains the athlete in efficient use of the sports equipment item.

20 Claims, 36 Drawing Sheets

(56) References Cited

U.S. PATENT DOCUMENTS 5,439,225 A * 8/1995 Gvoich ..... A63B 21/0081 473/223
5,441,255 A * 8/1995 Verbick ..... A63B 21/0611 473/422
5,595,384 A 1/1997 Hardison, Jr.
6,579,214 B2 * 6/2003 Crump ..... A63B 69/36 482/103
7,131,916 B2 11/2006 Griffin
7,150,682 B2 12/2006 Varner
7,217,202 B2 5/2007 Troxell
7,470,223 B1 * 12/2008 Haese ..... A63B 21/0088 482/111
7,517,290 B1 * 4/2009 Springer ..... A63B 69/0002 473/422
7,568,979 B2 * 8/2009 Arnold, Jr. ..... A63B 69/0057 473/227
7,841,971 B2 * 11/2010 Smith ..... A63B 21/06 473/229
7,914,390 B2 3/2011 Seiter et al.
D636,042 S * 4/2011 Campitelli ..... D21/789
8,043,162 B2 10/2011 Sery
8,147,357 B1 4/2012 Nichols
8,323,127 B2 12/2012 Webb et al.
8,852,032 B1 * 10/2014 Barnes ..... A63B 69/00 473/453
8,956,237 B2 * 2/2015 Campitelli ..... A63B 69/3614 473/220
2005/0014571 A1 1/2005 Varner
2006/0079341 A1 4/2006 Mansoor
2006/0135292 A1 * 6/2006 Griffin ..... A63B 69/0091 473/453
2013/0109510 A1 5/2013 Boehner
2014/0011602 A1 * 1/2014 Zimmerman, II .. A63B 69/3644 473/259

* cited by examiner

SECTION A-A

GUIDE ARM MACHINE

BACKGROUND

Mastering precise body motions to increase, efficiency, power, function and speed is important to gaining proficiency in a sport and for many types of rehabilitation. This mastery is often achieved by repetition. While repetition is important, it can be counter productive if the wrong motions are repeated. Therefore, it is important to make sure what is being repeated is the desired precise motion. Good coaching and use of training tools can be helpful to guide a sports competitor into proper motions for their sport.

DESCRIPTION OF THE EMBODIMENT

Figure 1:
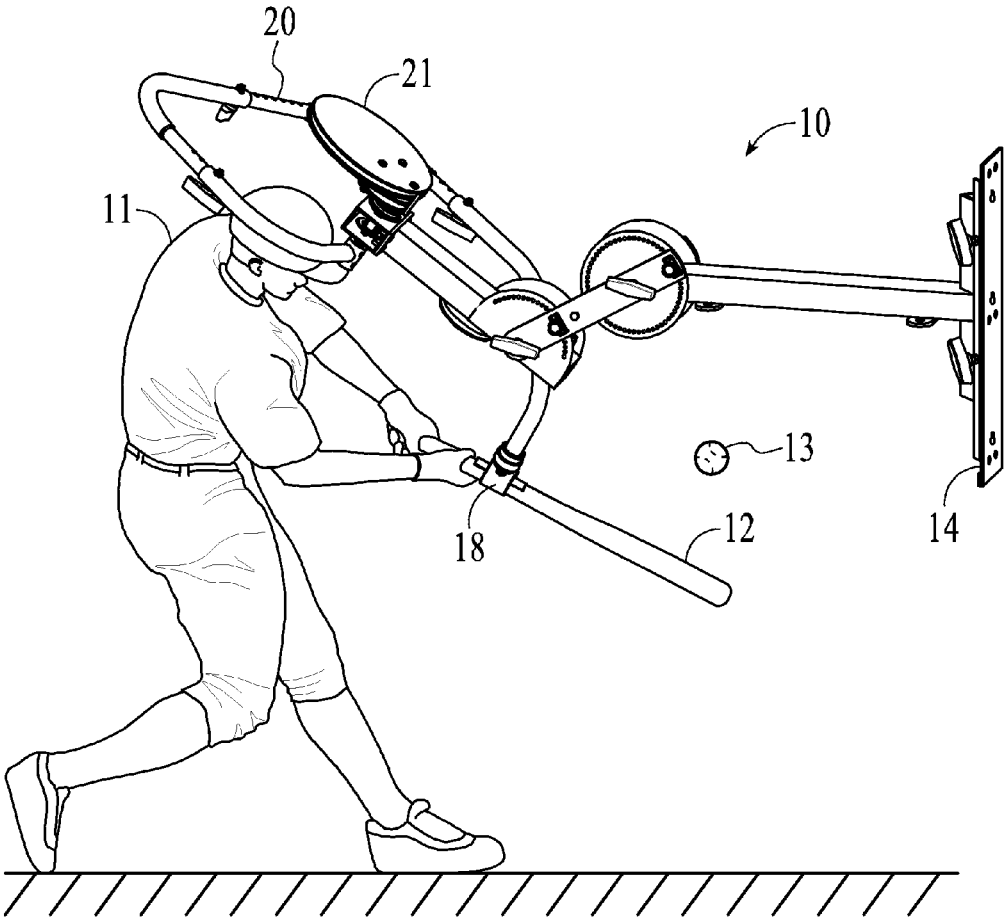
FIG. 1 shows a guide arm machine being used to aid a baseball player groove an efficient swing in accordance with an implementation.

FIG. 1 shows a baseball batter 11 using a guide arm machine 10 to groove an efficient swing. A bat 12 through a bat collar 18 is attached to a guide arm 20. A multi-tiered cam 21 allows varied resistance as bat 12 is swung in a desired swing plane. A baseball 13 represents a contact location of the swing. Guide arm machine 10 is attached to a wall using a wall mount 14.

While FIG. 1 shows guide arm 20 attached to a bat collar, this is only a particular implementation. Bat collar 18 can be replaced with another type of equipment holder optimized to hold another sports equipment item such as a ball, racquet, stick, handle or a golf club. Also, while FIG. 1 shows guide arm machine 10 arranged to attached to a wall, instead guide arm machine 10 can be arranged to attached to another stationary anchor such as a floor, a pole or a fence, etc. Guide arm machine 10 can also be free standing.

Figure 2:
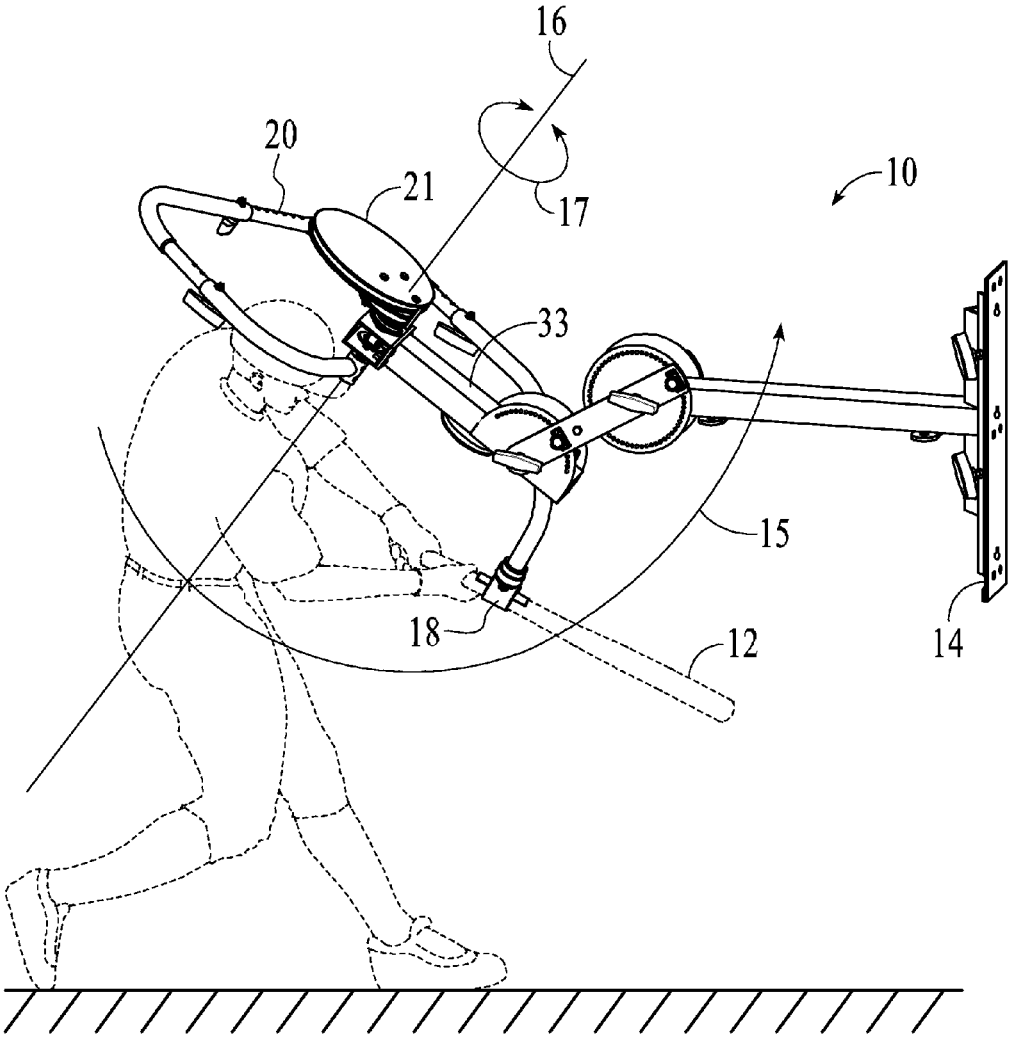
FIG. 2 shows more detail of the guide arm machine shown in FIG. 1 in accordance with an implementation.

FIG. 2 shows a rotation axis 16 for multi-tiered cam 21. Rotation around rotation axis 16 is represented by arrow 17. A swing path 15 represents a guided swing path for bat 12. Multi-tiered cam 21 is attached to an adjustable main beam 33. Since rotation axis 16 is roughly perpendicular to an adjustable main beam 33, adjusting the angle of adjustable main beam 33 adjusts the swing plane of swing path 15.

Figure 3:
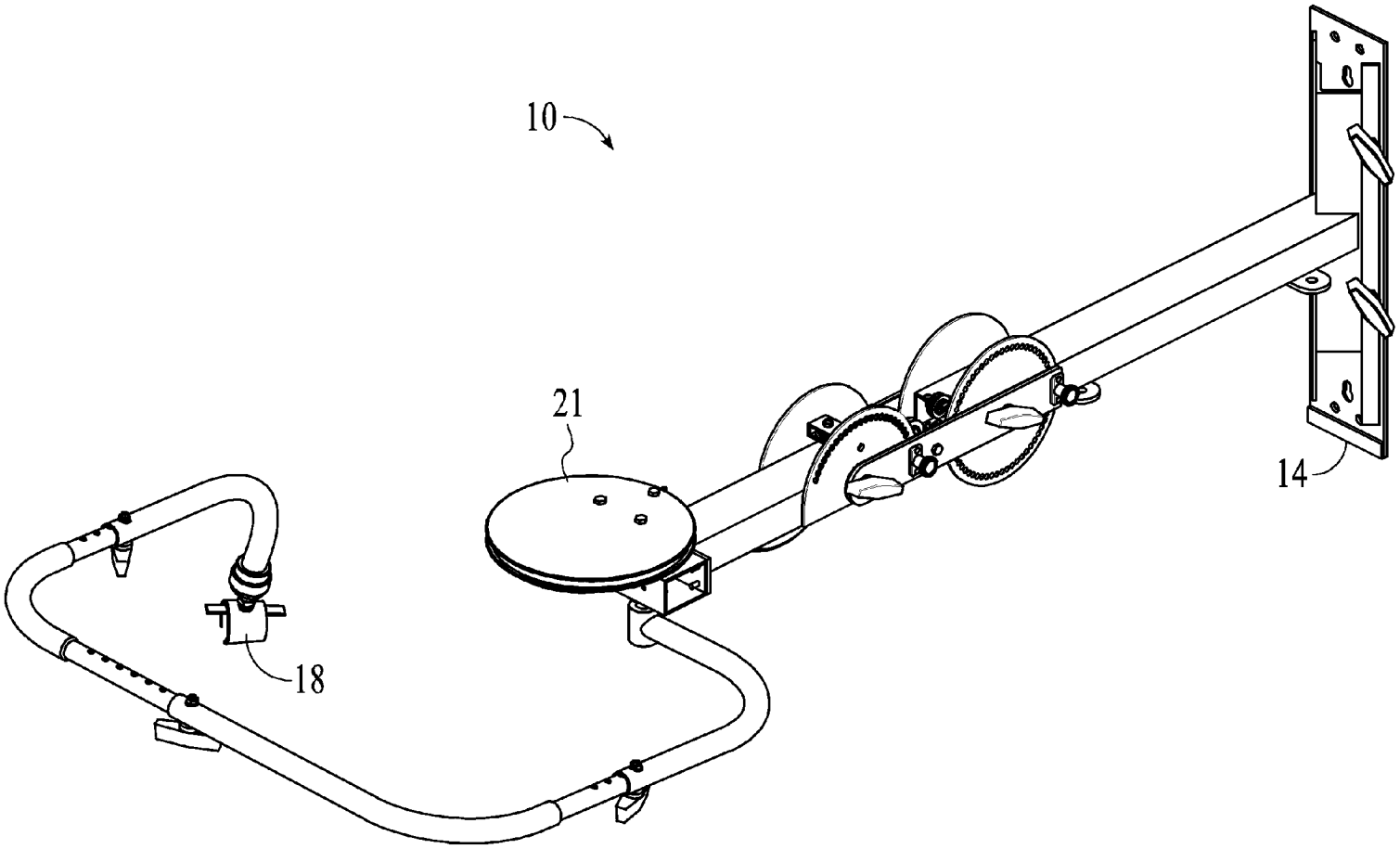
FIG. 3 shows more detail of the guide arm machine shown in FIG. 1 in accordance with an implementation.

FIG. 3 shows guide arm machine 10 from a different angle so that all of arm 20 is visible.

Figure 4:
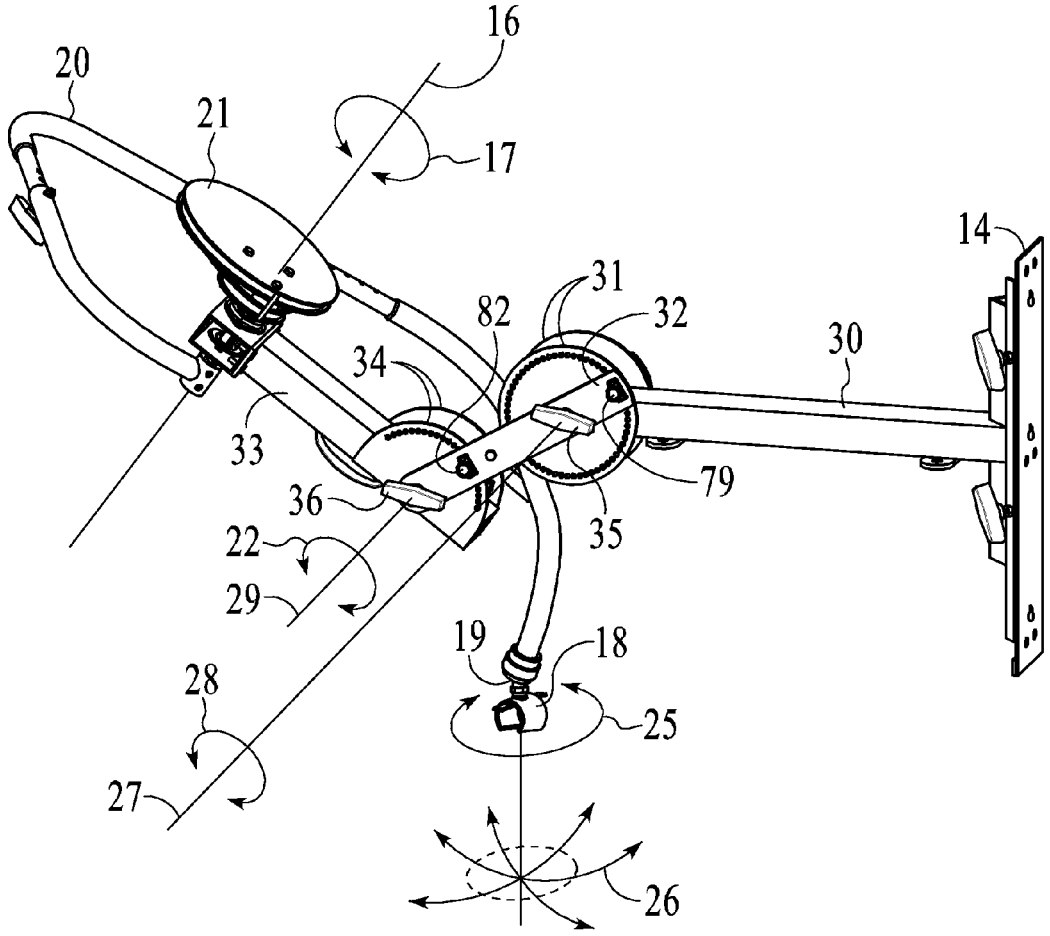
FIG. 4 shows more detail of the guide arm machine shown in FIG. 1 in accordance with an implementation.

FIG. 4 illustrates some adjustments than can be made to guide arm machine 10. Round base plates 31 can be used to adjust an angle between fixed main frame beam 30 and lever adjusters 32 around an axis 27 as indicated by arrows 28. For example, lever adjusters 32 are made of steel or another sturdy material. A T-knob 35 and a retractable plate mount spring plunger 79 are used to make and hold the adjustment. Half round base plates 34 can be used to adjust an angle between lever adjusters 32 and adjustable main beam 33 around an axis 29 as indicated by arrows 22. A T-knob 36 and a retractable plate mount spring plunger 82 are used to make and hold the adjustment.

While FIG. 4 shows round base plates 32 used to adjust an angle between fixed main frame beam 30 and lever adjusters 32, this can be achieved through other means other than round base plates 32. What is important is that an angle between fixed main frame beam 30 and lever adjusters 32 can be adjusted allowing adjustment of position of the adjustable main beam 33 with respect to the wall or some other stationary anchor. Likewise, while FIG. 4 shows half round base plates 34 being used to adjust an angle between lever adjusters 32 and adjustable main beam 33, this can be achieved through other means other than half round base plates 34. What is important is that an angle between lever adjusters 32 and adjustable main beam 33 can be adjusted allowing adjustment of position of the adjustable main beam 33 with respect to the wall or some other stationary anchor.

A threaded universal joint 19 allows bat collar 18 to rotate as indicated by arrows 25, and allows bat collar 18 to tilt with respect to guide arm 20, as indicated by arrows 26. The existence of threaded universal joint 19 allows the batter to turn the bat during the swing as well as change wrist angle. The use of a universal joint at this location in the guide arm is useful to allow motion helpful not only for a batter but for other sports. For example, in the softball pitching motion example described below, the existence of a universal joint allows for a pitching motion that puts spin on the softball as it is pitched. One or more additional universal joints can be added to increase mobility within guide arm 20.

Figure 5:
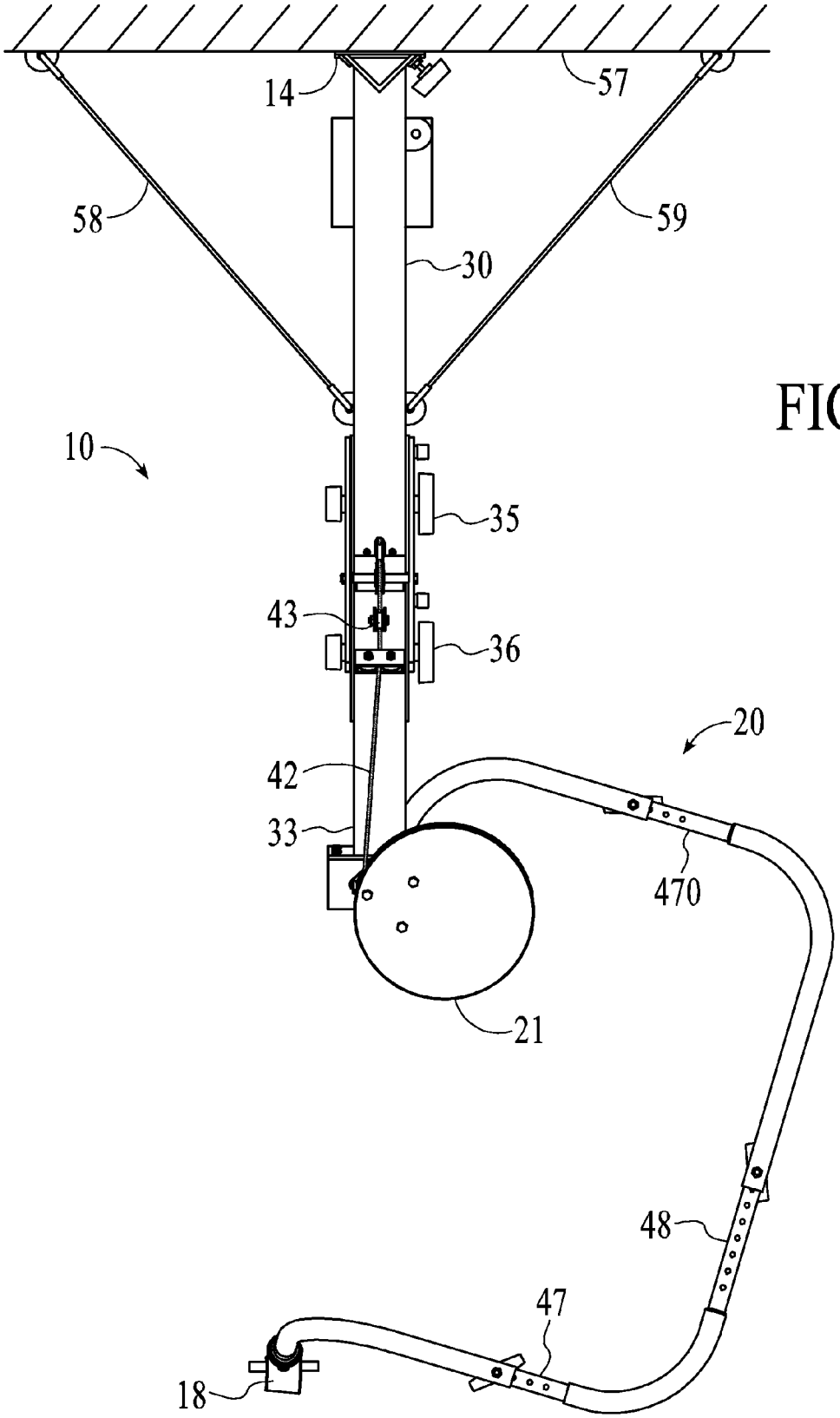
FIG. 5 shows more detail of the guide arm machine shown in FIG. 1 in accordance with an implementation.

FIG. 5 shows a top view of guide arm machine 10. A wire or rope cord 58 and a wire or rope cord 59 can be used to help anchor guide arm machine 20 to a wall 57. A cord 42 is wrapped around a tier of multi-tier cam 21 and is fed through a pulley 43. Cord 42 can be attached to a resistance component to rotation of multi-tier cam 21. For example, the resistance component could be accomplished by connecting cord 42 to a device that provides resistance by use of counterweight, spring pressure, metal resistance, pressure plates, friction plates, magnetic resistance through a simple battery, flexible steel, rubber bands, hydraulic oil resistant orifices, temperature sensing resistance material, oblong cams, a type of braking materials or in some other fashion. In addition or instead, the resistance component can be implemented directly to multi-tier cam 21 without using cord 42.

Figure 6:
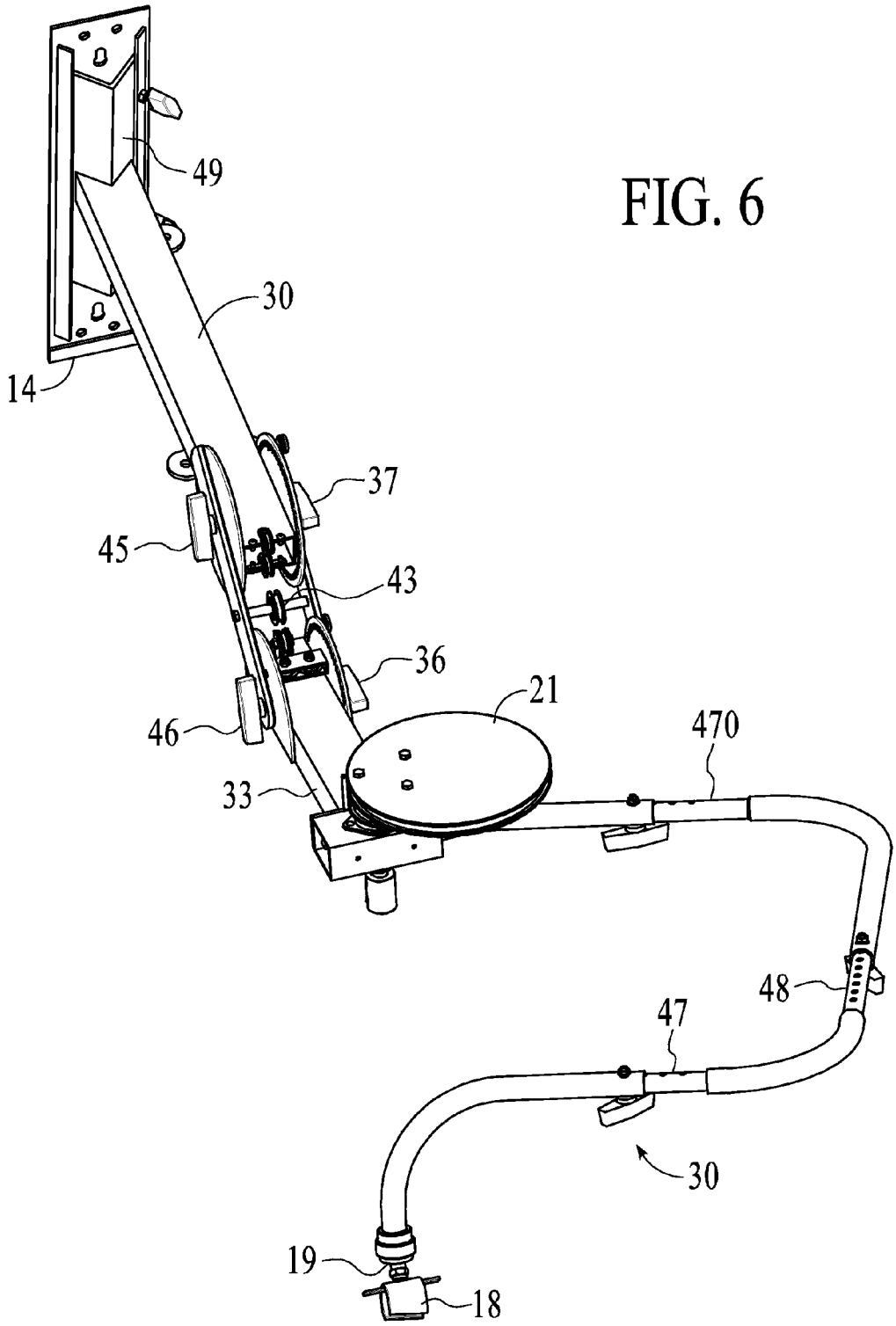
FIG. 6 shows more detail of the guide arm machine shown in FIG. 1 in accordance with an implementation.
Figure 7:
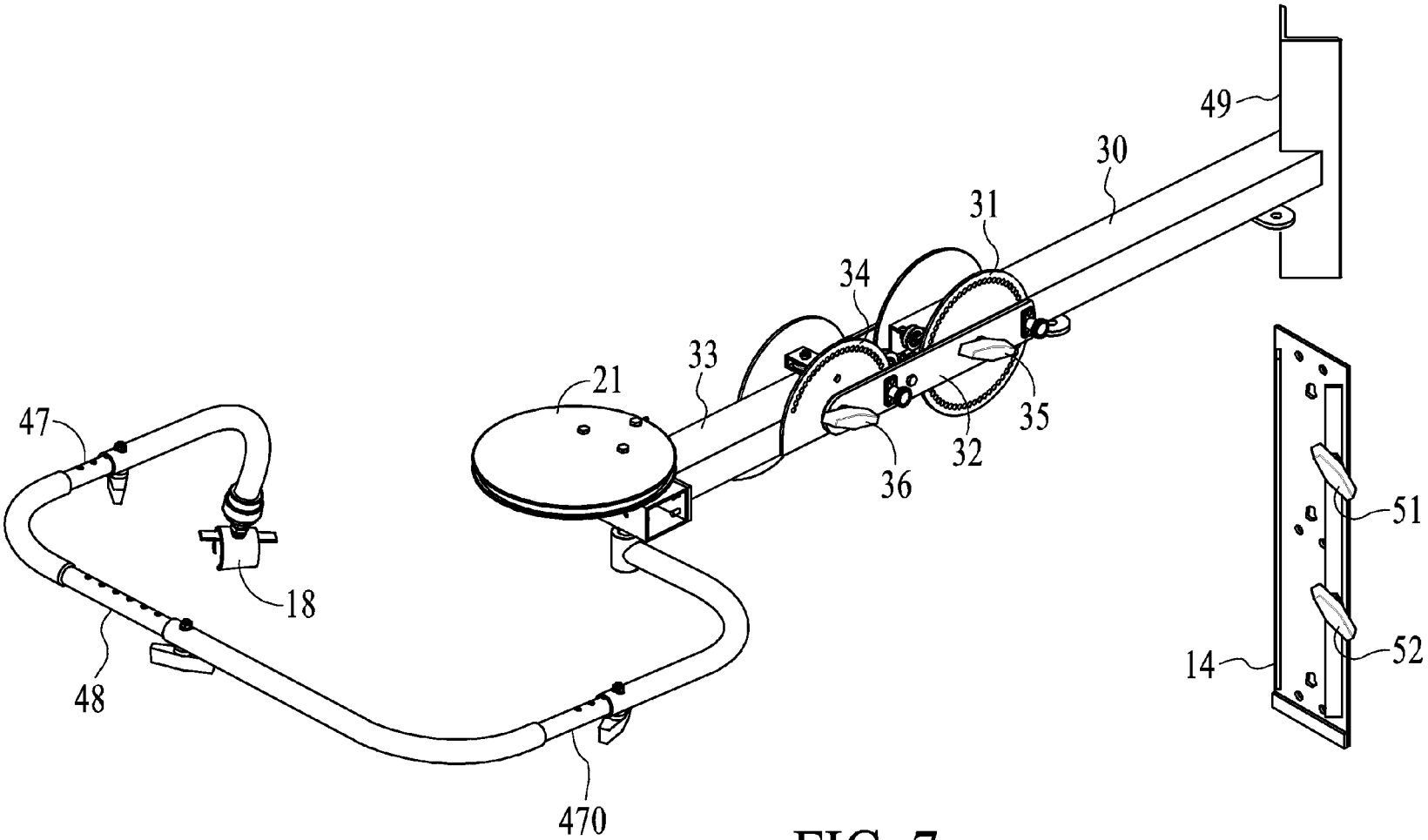
FIG. 7 shows more detail of the guide arm machine shown in FIG. 1 in accordance with an implementation.

In FIG. 6, a base angle iron 49 is used to hold main frame beam 30 to wall mount 14. A T-knob 46 and a T-knob 45 are also shown In FIG. 7, base angle iron 49 is shown separated from wall mount 14.

Figure 8A:
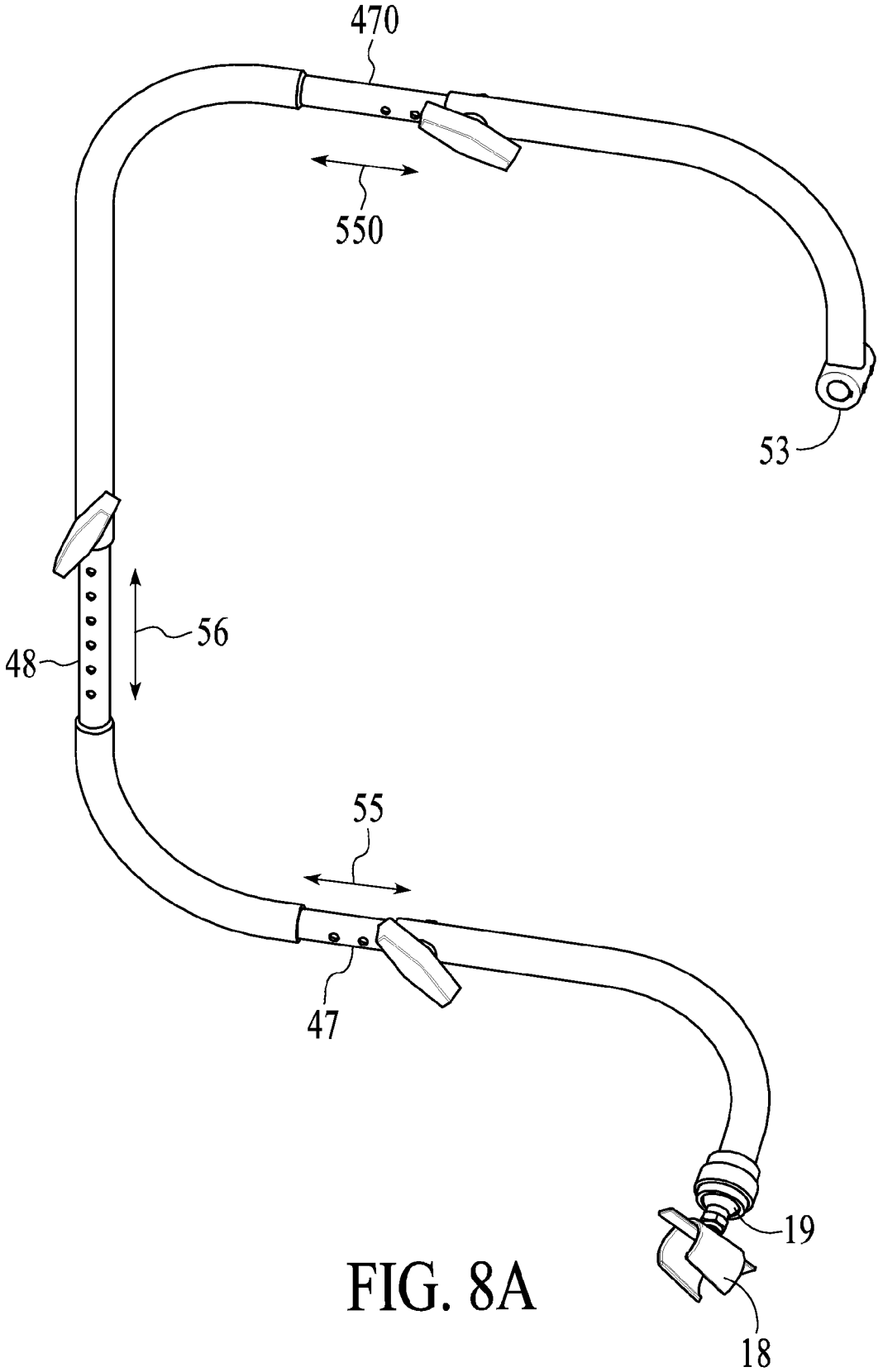
FIG. 8A and FIG. 8B show more detail of the guide arm for the guide arm machine shown in FIG. 1 in accordance with an implementation.
Figure 8B:
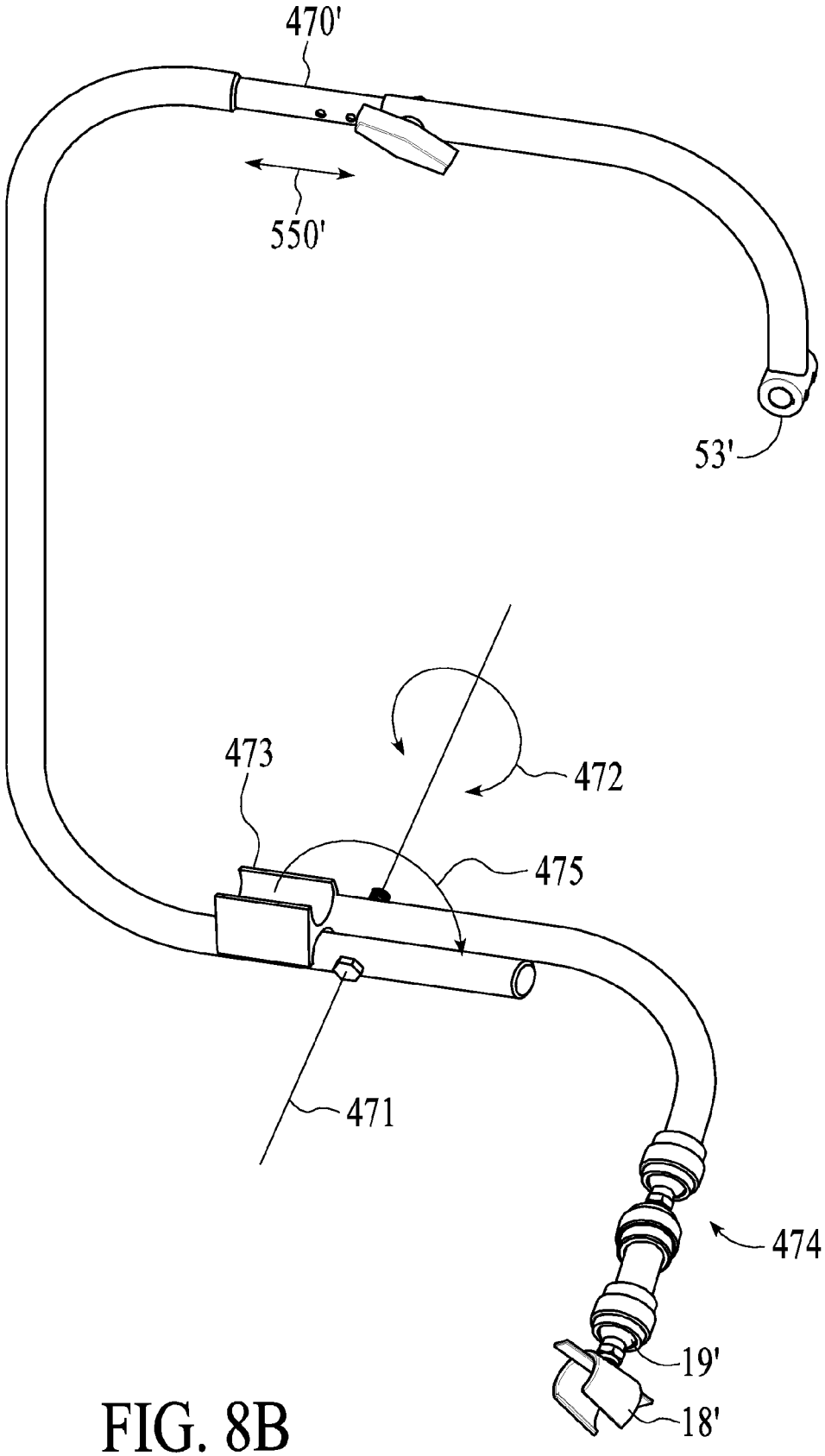

FIG. 8A and FIG. 8B illustrate how guide arm 20 can be adjusted to obtain a desired swing path shown in FIG. 2. In FIG. 8A, a section 47 can be shortened or lengthened to adjust size of guide arm 20 in the first (x) dimension, as illustrated by arrows 55. In addition, a section 470 can also be shortened or lengthened to adjust size of guide arm 20 in the first (x) dimension, as illustrated by arrows 550. A section 48 can also be shortened or lengthened to adjust size of guide arm 20 in a first (y) dimension, as illustrated by arrows 56. Coupling 53 is also shown in FIG. 8A.

In FIG. 8B, a section 470' can be shortened or lengthened in the first (x) dimension, as illustrated by arrows 550'. FIG. 8B also shows some additional versatility provided by an additional universal joint 474 and a sleeve 473 that can be adjusted in a direction 475, as a result of a pivot motion 472 around an axis 471. This additional flexibility can be useful to help accommodate various athletic motions. Also shown in FIG. 8B are coupling 53', a bat collar 18' and a threaded universal joint 19'.

Figure 9:
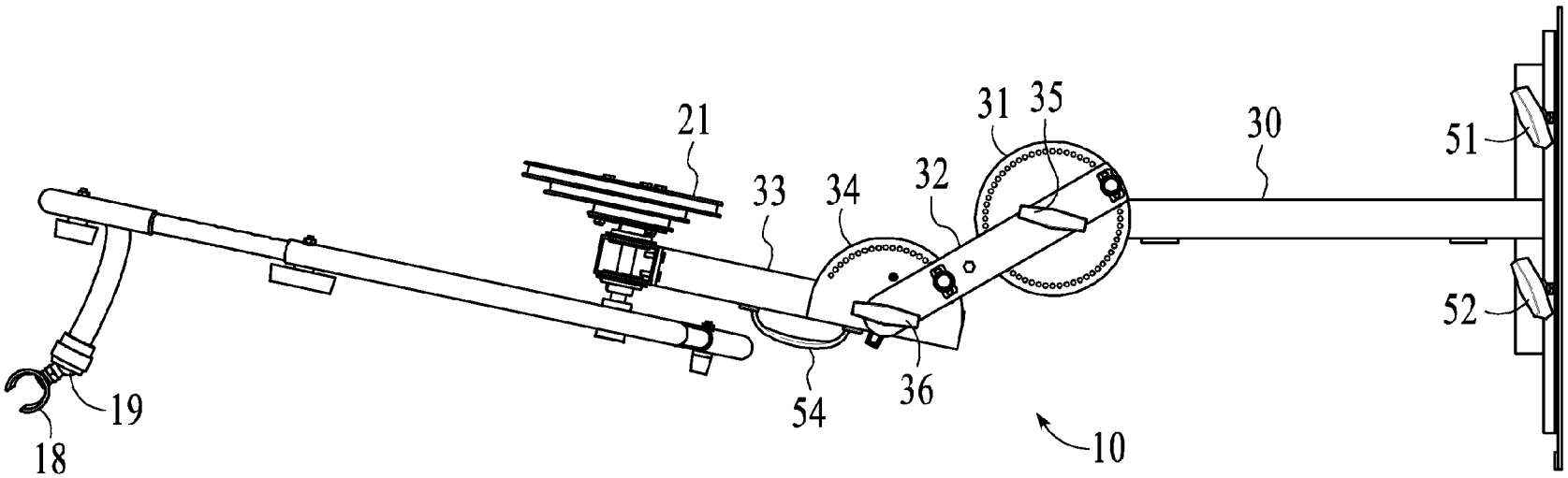
FIG. 9 shows more detail of the guide arm machine shown in FIG. 1 in accordance with an implementation.

FIG. 9 shows a side elevated view of guide arm machine 10. A handle 54 is also shown.

Figure 10:
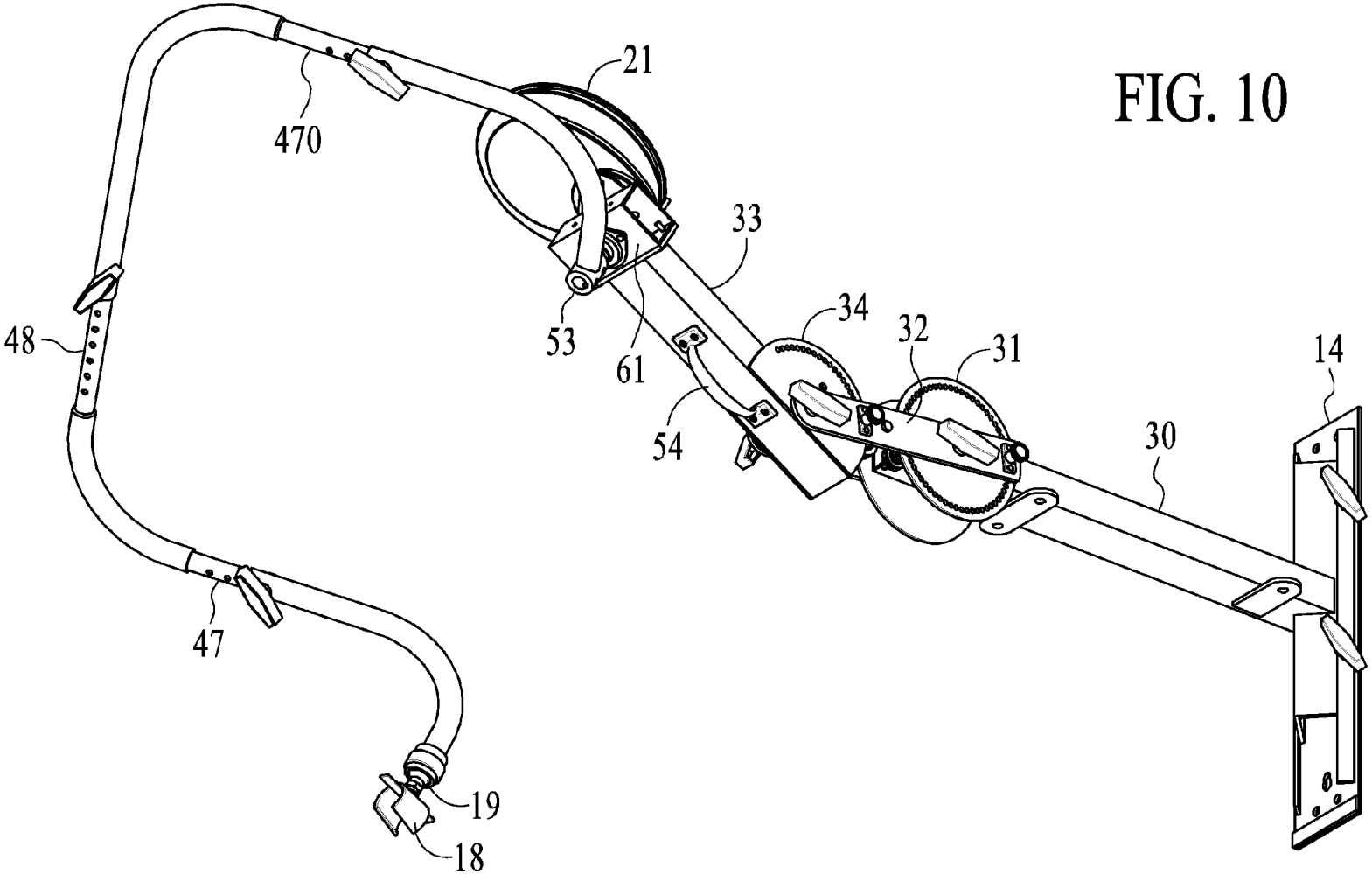
FIG. 10 shows more detail of the guide arm machine shown in FIG. 1 in accordance with an implementation.

FIG. 10 shows another view of guide arm machine 10. In FIG. 10, guide arm 20 is shown connected to shaft housing 61 via coupling 53. This implementation is shown again in FIG. 15 and discussed further below.

Figure 11:
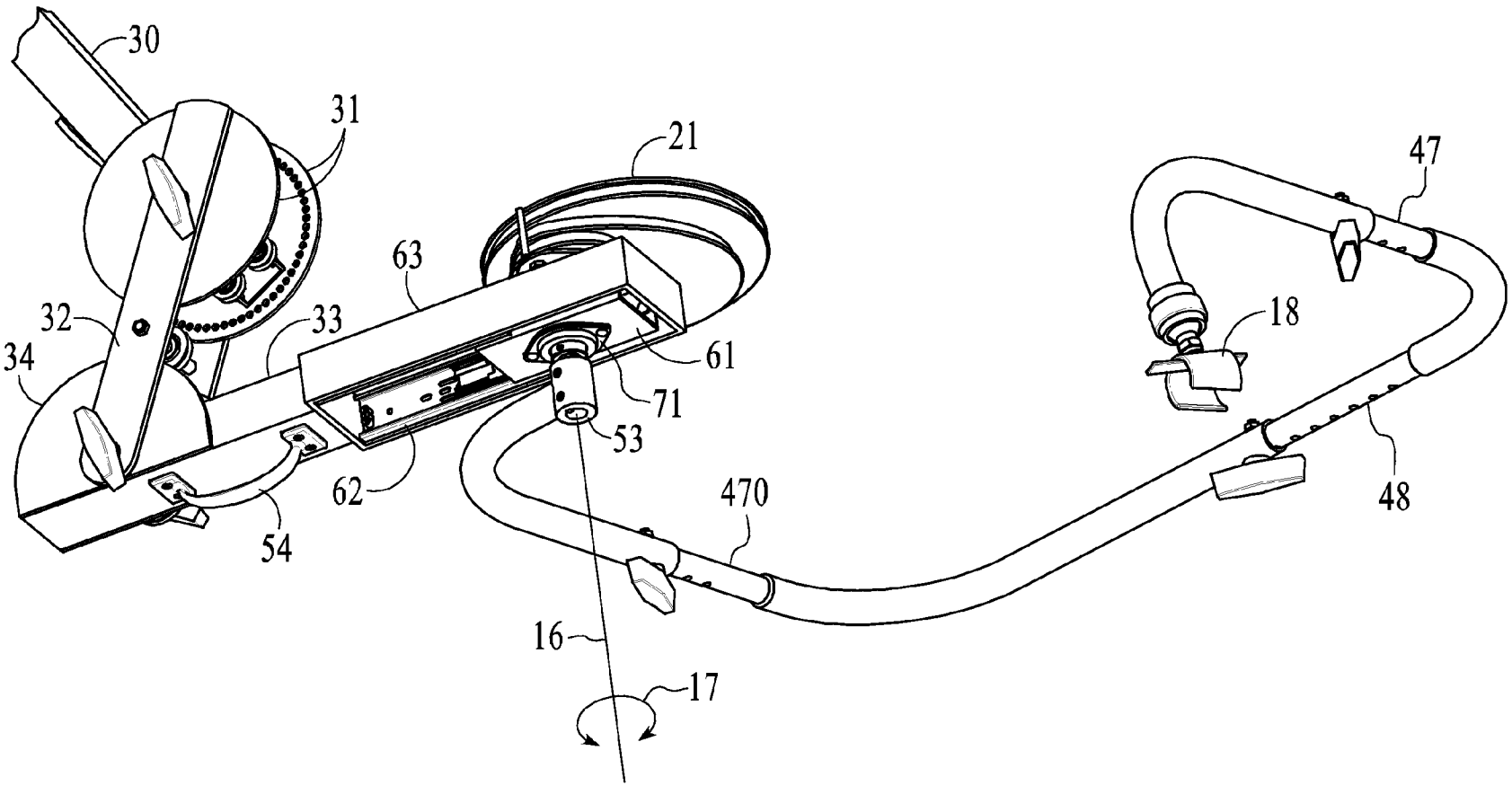
FIG. 11 shows more detail of the guide arm machine shown in FIG. 1 in accordance with an implementation.

In FIG. 11, section 48 of guide arm 20 is shown connected to a shaft housing 61 at a collar 71 via a coupling 53. FIG. 11 differs from FIG. 10 in that housing 61 is able to move along tracks 62 within a rectangular frame 63. This allows rotation axis 16 of multi-tiered cam 21 to move up and down along the length of adjustable main beam 33 during the swing of batter 11. Batter 11 is thus allowed to make adjustments to alter his hand path and swing plane during use. This ability to change hand path and swing plane allows a lot of versatility for the batter to make adjustments while performing motion.

Figure 12:
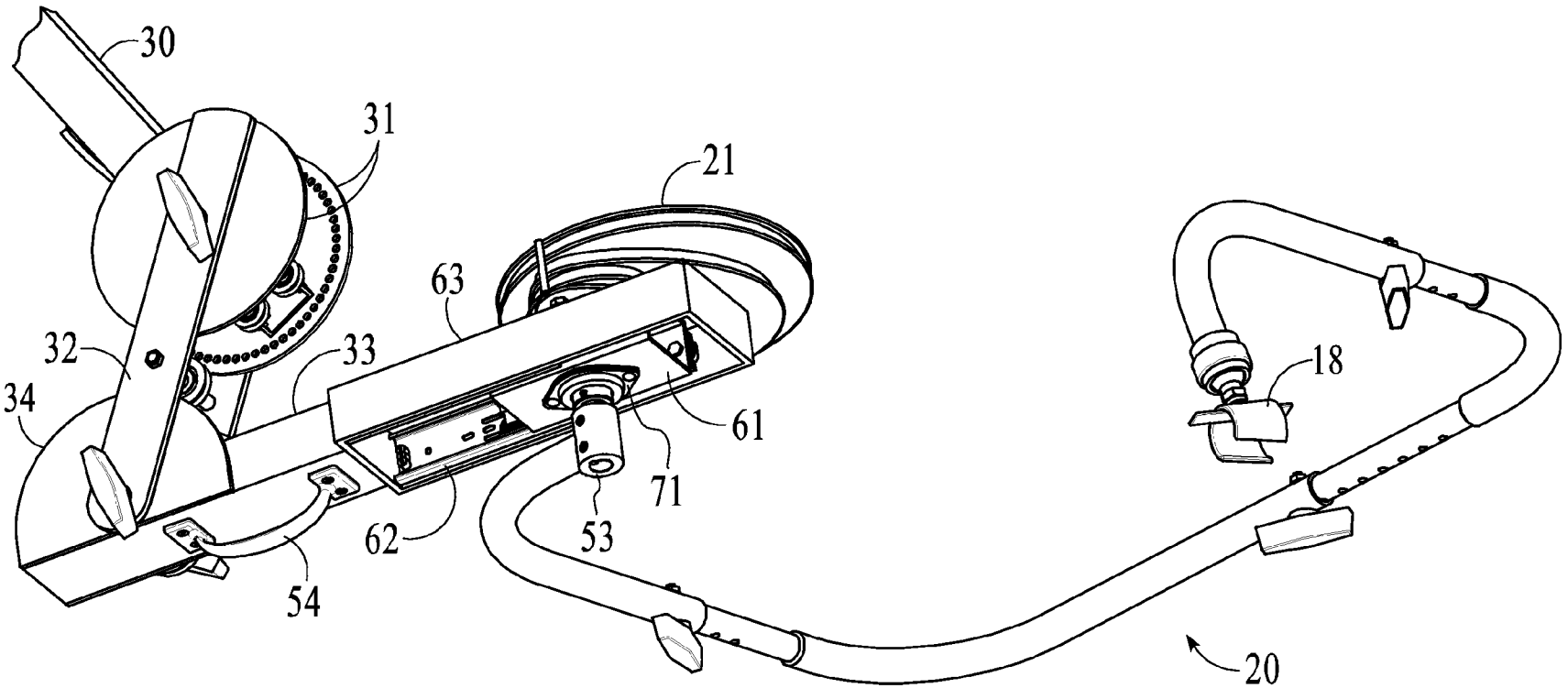
FIG. 12 shows more detail of the guide arm machine shown in FIG. 1 in accordance with an implementation.

In FIG. 12, housing 61 has moved to a different location along tracks 62 within rectangular frame 63 as compared to the position of housing 61 along tracks 62 within rectangular frame 63 shown in FIG. 11.

Figure 13:
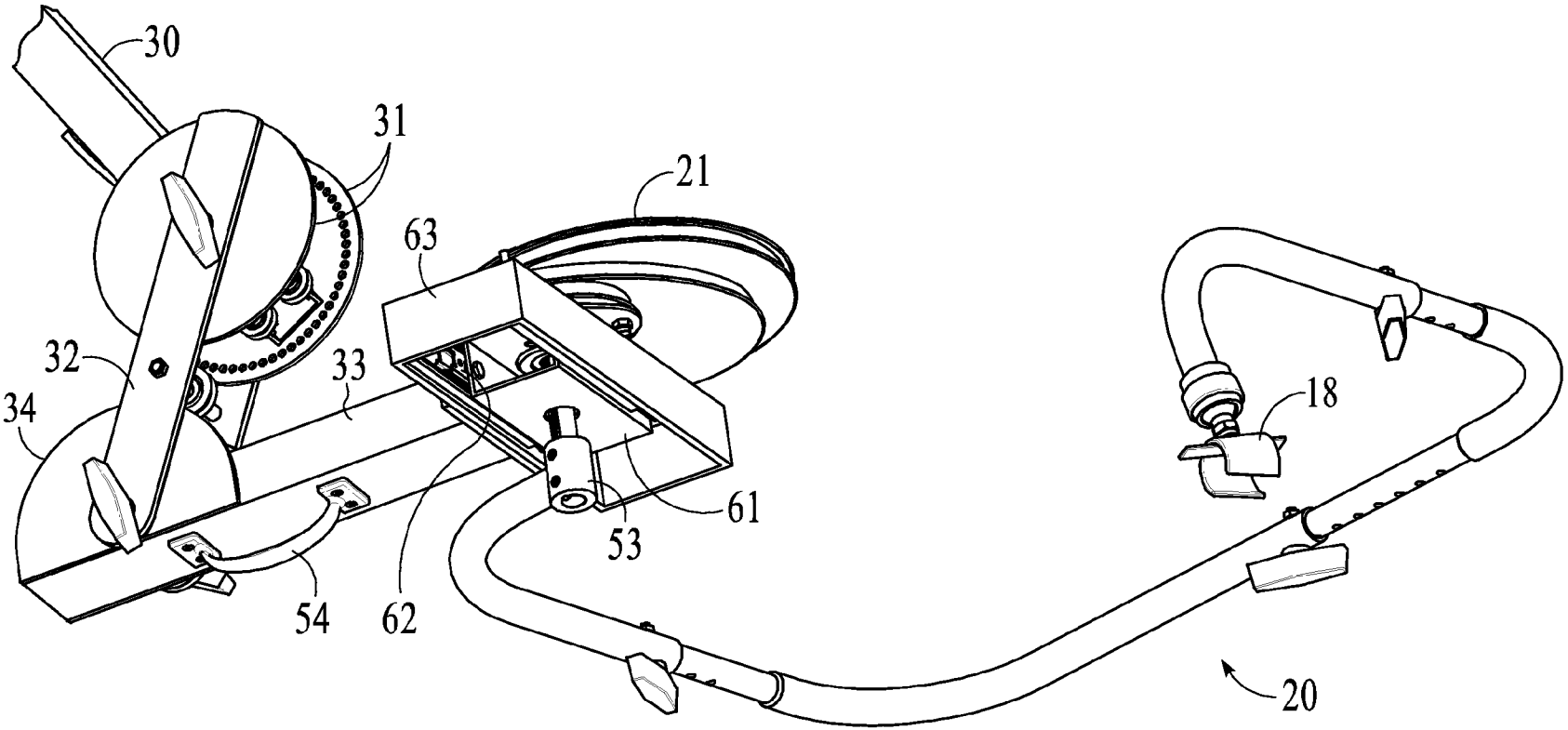
FIG. 13 shows more detail of the guide arm machine shown in FIG. 1 in accordance with an implementation.

In FIG. 13, rectangular frame 63 has been rotated 90 degrees so housing 61 is able to move along tracks 62 within a rectangular frame 63 in a direction perpendicular to the length of adjustable main beam 33. This allows rotation axis 16 (shown in FIG. 11) of multi-tiered cam 21 to move perpendicular to the length of adjustable main beam 33 during the swing of batter 11. This ability to change hand path and swing plane allow additional versatility for the batter to make adjustments while performing motion. This is important for taking into account stride and forward momentum of batters.

Figure 14:
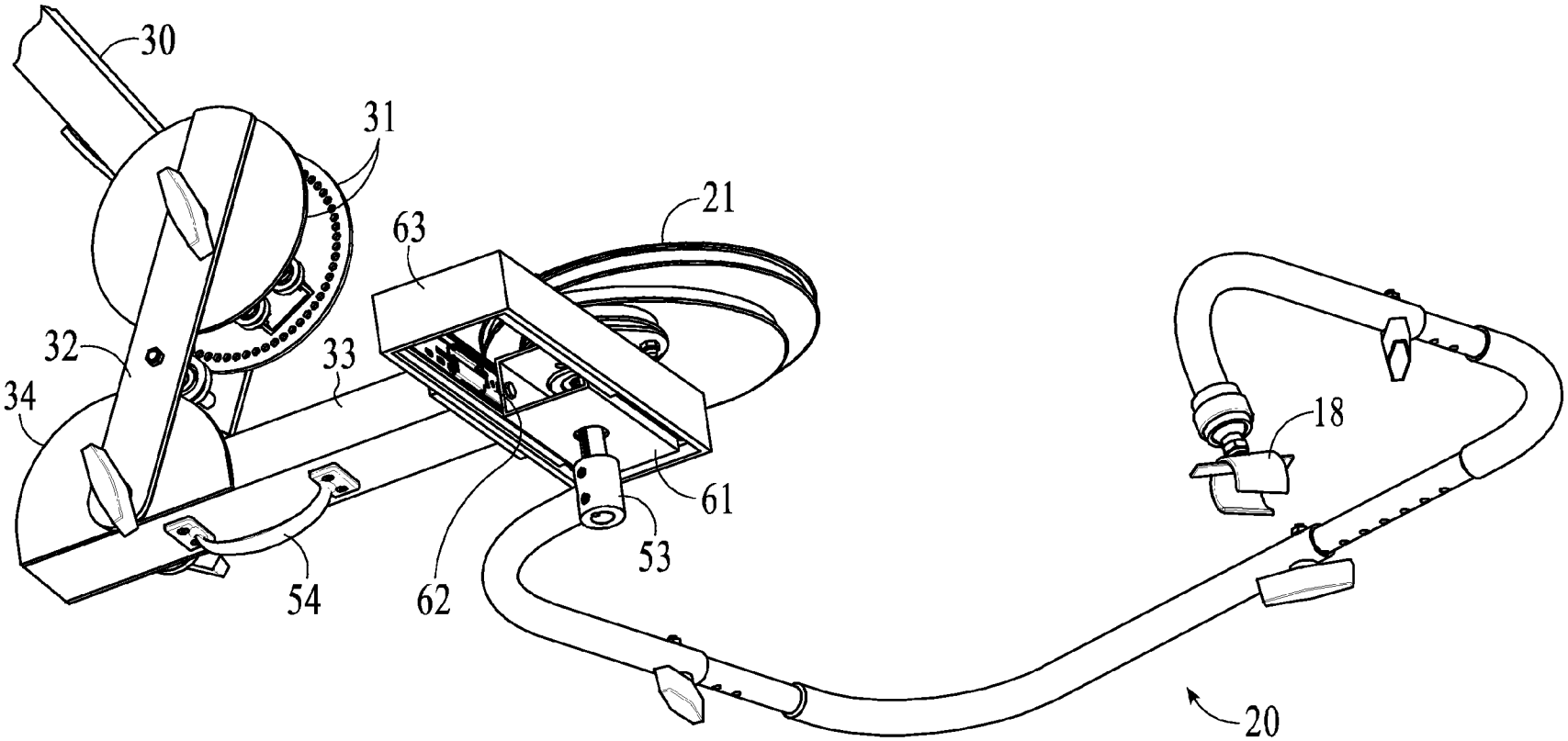
FIG. 14 shows more detail of the guide arm machine shown in FIG. 1 in accordance with an implementation.

In FIG. 14, housing 61 has moved to a different location along tracks 62 within rectangular frame 63 as compared to the position of housing 61 along tracks 62 within rectangular frame 63 shown in FIG. 13.

Figure 15:
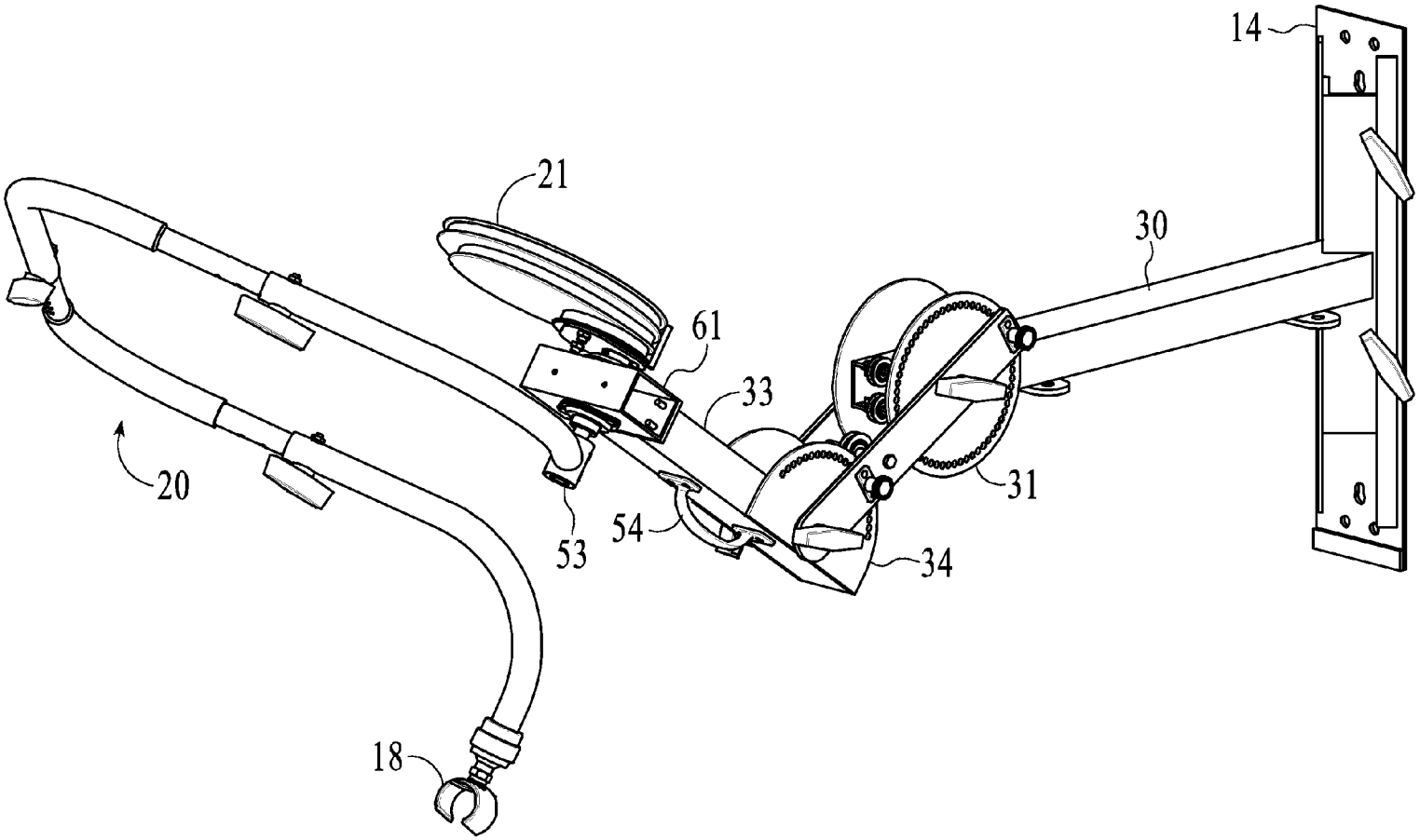
FIG. 15 shows more detail of the guide arm machine shown in FIG. 1 in accordance with an implementation.

In FIG. 15, guide arm 20 is shown connected to shaft housing 61 via coupling 53; however, rectangular frame 63 and tracks 62 are not included in this implementation. In this implementation, rotation axis 16 (shown in FIG. 11) of multi-tiered cam 21 remains fixed with respect to adjustable main beam 33 during the swing of batter 11.

Figure 16:
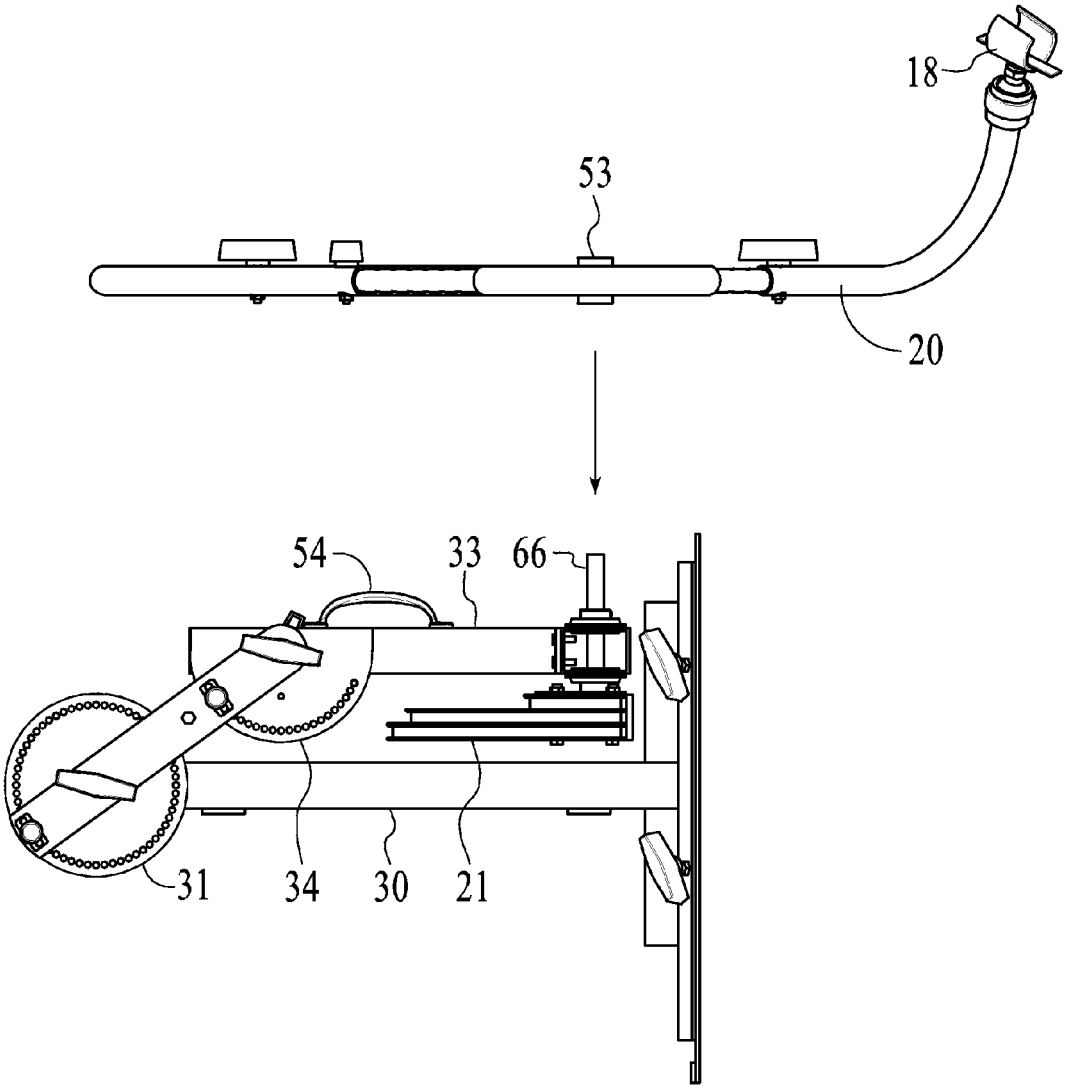
FIG. 16 shows more detail of the guide arm machine shown in FIG. 1 in accordance with an implementation.

FIG. 16 shows adjustable main beam 33 folded up above main frame beam 30. A shaft 66 from multi-tiered cam 21 is ready to be inserted into coupling 53 of guide arm 20. Handle 54 makes for easy gripping when transporting guide arm machine 10.

Figure 17:
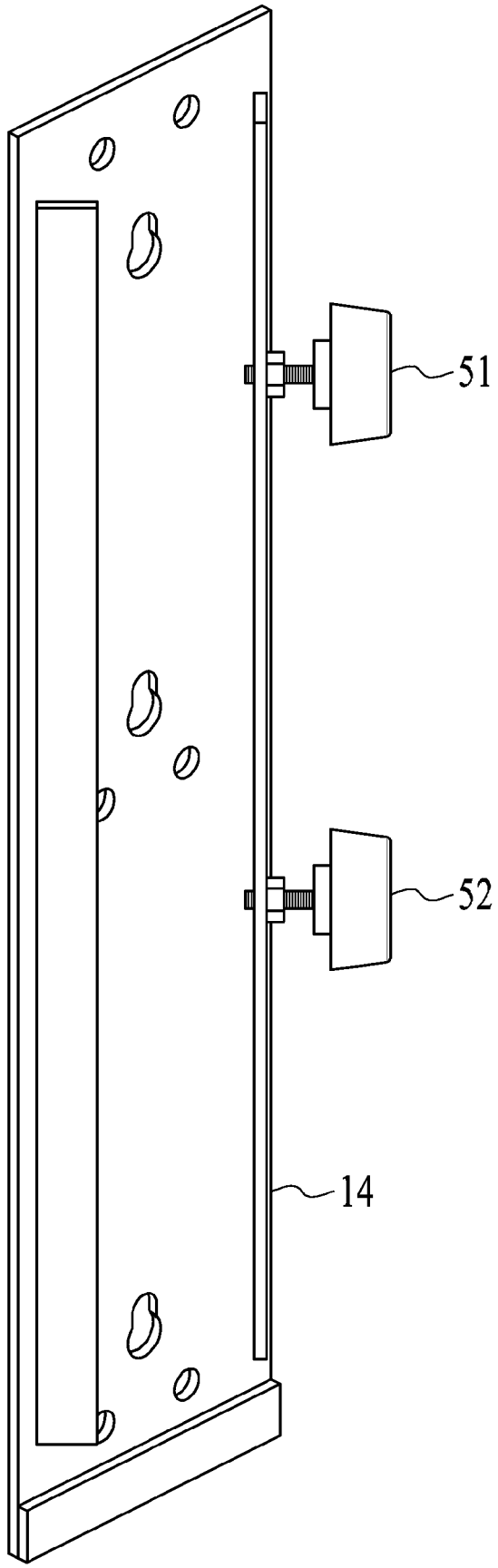
FIG. 17 shows more detail of a wall mount for the guide arm machine shown in FIG. 1 in accordance with an implementation.

FIG. 17 shows details of wall mount 14. A T-knob 51 and a T-knob 52 are used to secure base angle iron within wall mount 14.

Figure 18:
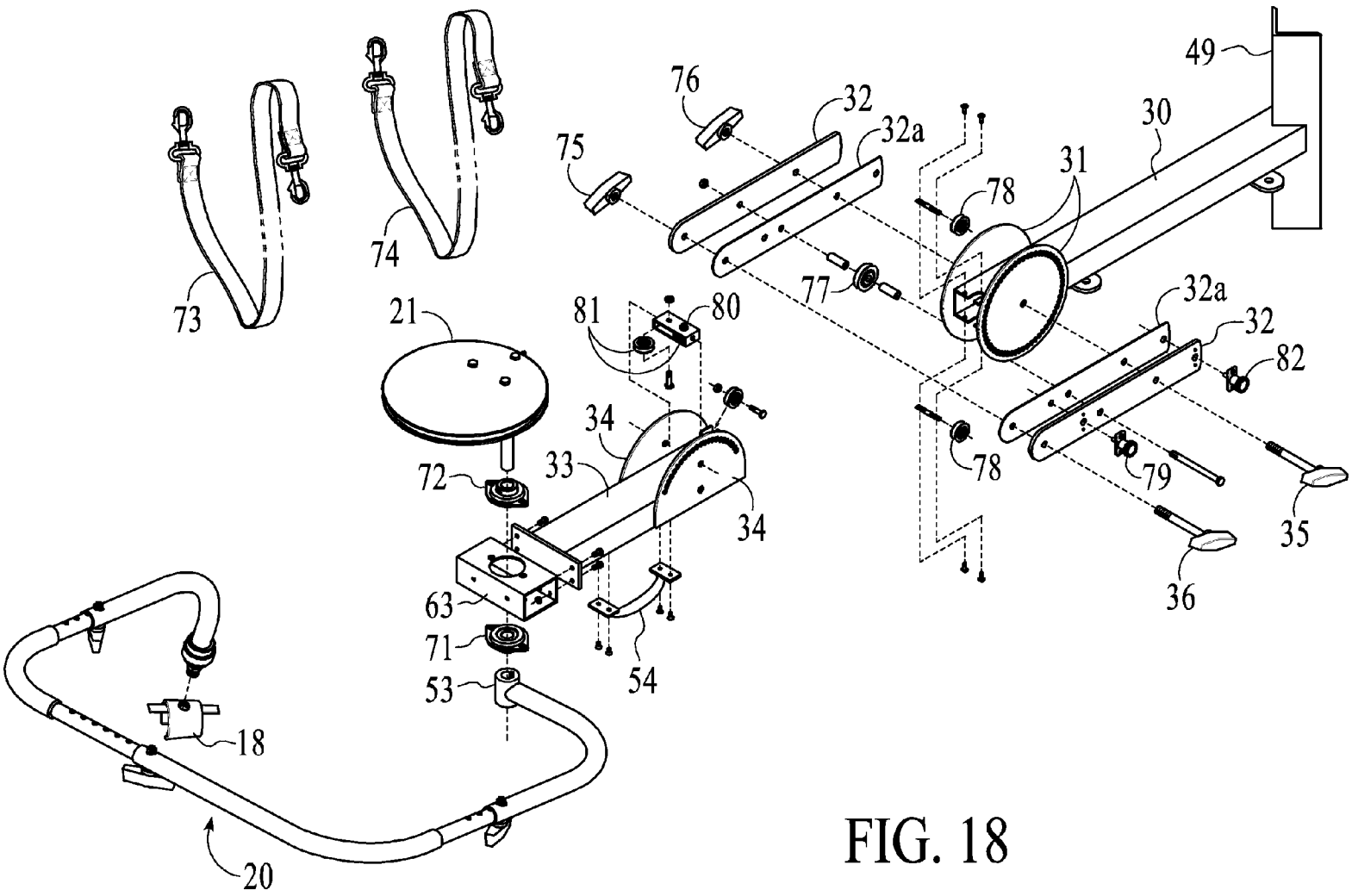
FIG. 18 shows parts for the guide arm machine shown in FIG. 1 in accordance with an implementation.

FIG. 18 shows various parts of guide arm machine 10. A retractable ratchet strap 73 and a retractable ratchet strap 74 are used to tighten down and secure guide arm machine 10. Pulleys 78 and pulley 77 are also shown. Additionally, FIG. 18 shows bat collar 18, guide arm 20, multi-tiered cam 21, fixed main frame beam 30, round base plates 31, lever adjusters 32, matching pieces 32*a*, adjustable main beam 33, half round base plates 34, T-knob 35, base angle iron 49, coupling 53, handle 54, rectangular frame 63, collar 71, collar 72, a wing nut 75, a wing nut 76, retractable plate mount spring plunger 79, dual pulley housing 80, pulleys 81 and retractable plate mount spring plunger 82, as further described above.

Figure 19:
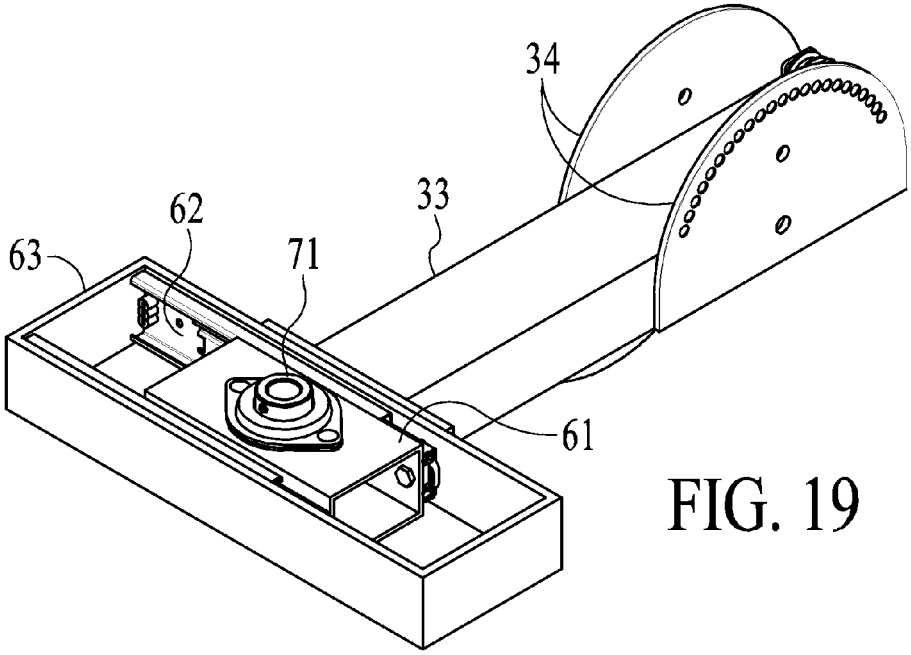
FIG. 19 shows more detail of shaft housing for the guide arm machine shown in FIG. 1 in accordance with an implementation.

FIG. 19 shows rectangular frame 63 attached to adjustable main beam 33 so housing 61 is able to move along tracks 62 within rectangular frame 63 in a direction perpendicular to the length of adjustable main beam 33.

Figure 20:
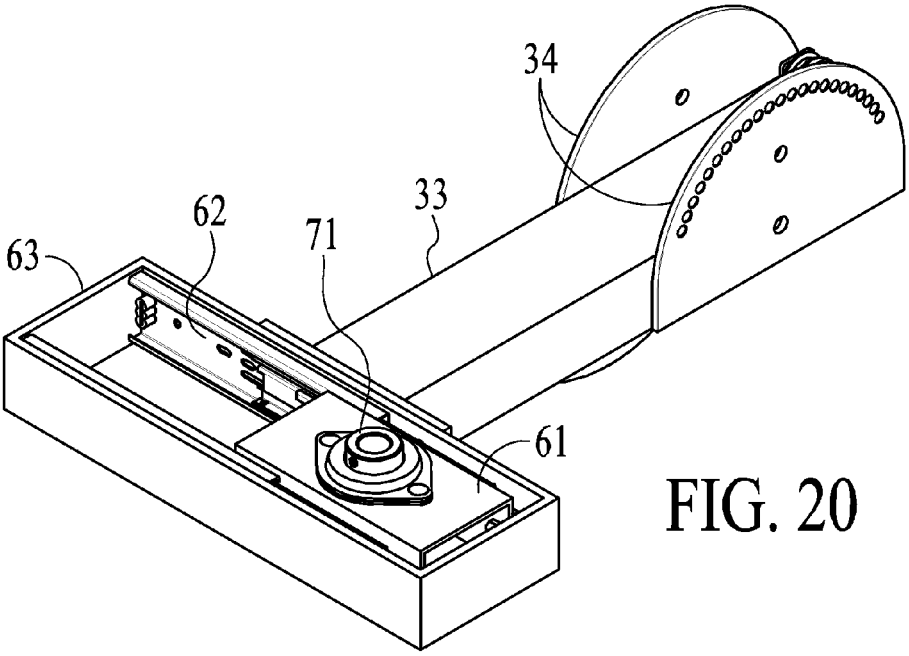
FIG. 20 shows more detail of shaft housing for the guide arm machine shown in FIG. 1 in accordance with an implementation.

In FIG. 20, housing 61 has moved to a different location along tracks 62 within rectangular frame 63 as compared to the position of housing 61 along tracks 62 within rectangular frame 63 shown in FIG. 19.

Figure 21:
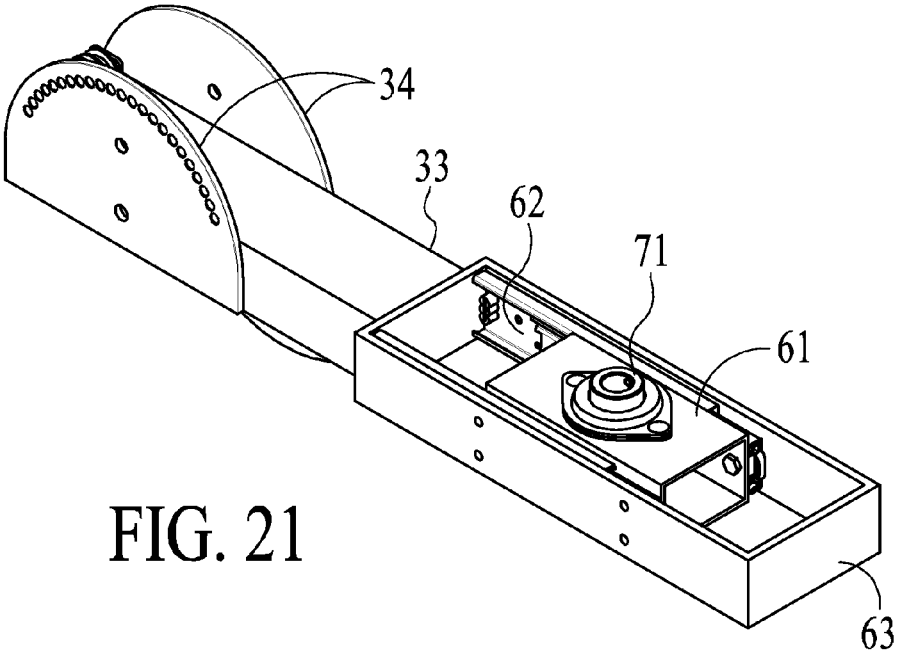
FIG. 21 shows more detail of shaft housing for the guide arm machine shown in FIG. 1 in accordance with an implementation.

FIG. 21 shows rectangular frame 63 attached to adjustable main beam 33 so housing 61 is able to move along tracks 62 within rectangular frame 63 in a direction along the length of adjustable main beam 33.

Figure 22:
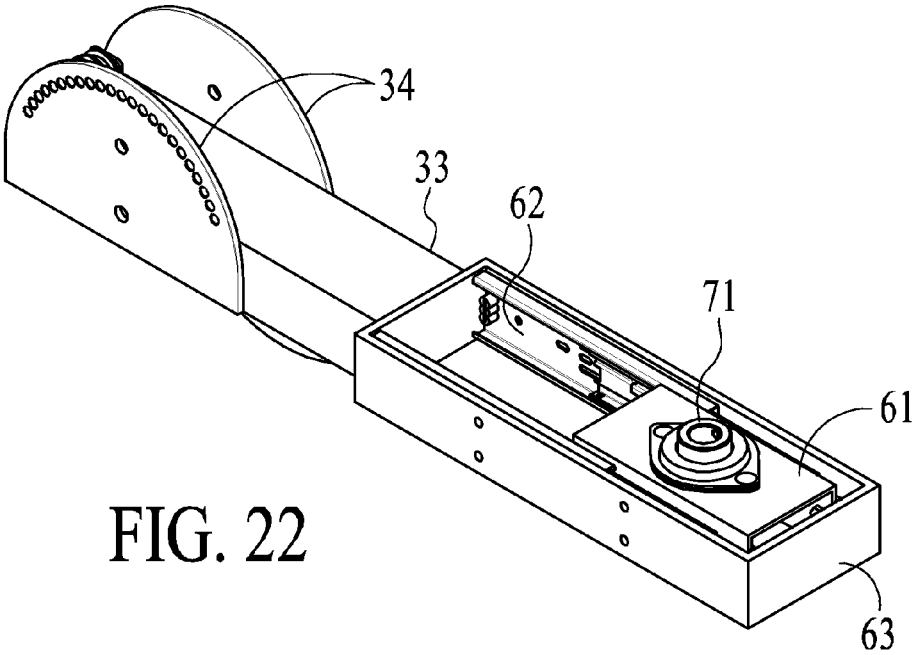
FIG. 22 shows more detail of shaft housing for the guide arm machine shown in FIG. 1 in accordance with an implementation.

In FIG. 22, housing 61 has moved to a different location along tracks 62 within rectangular frame 63 as compared to the position of housing 61 along tracks 62 within rectangular frame 63 shown in FIG. 21.

Figure 23:
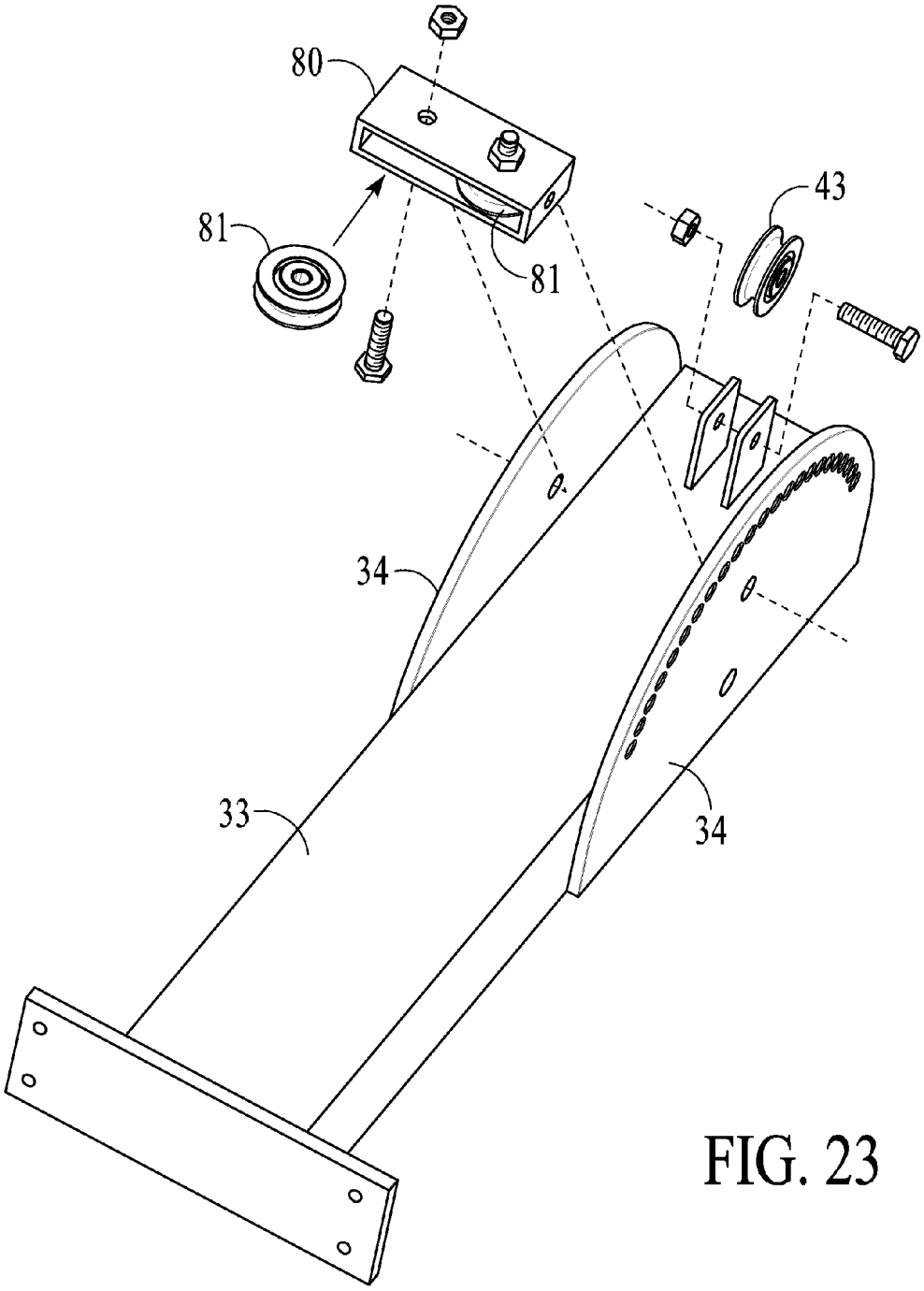
FIG. 23 shows more detail of pulleys for the guide arm machine shown in FIG. 1 in accordance with an implementation.

FIG. 23 shows a pulley 43 being mounted on adjustable main beam 33. Dual pulley housing 80 including pulleys 81 is also mounted on adjustable main beam 33 as shown.

Figure 24:
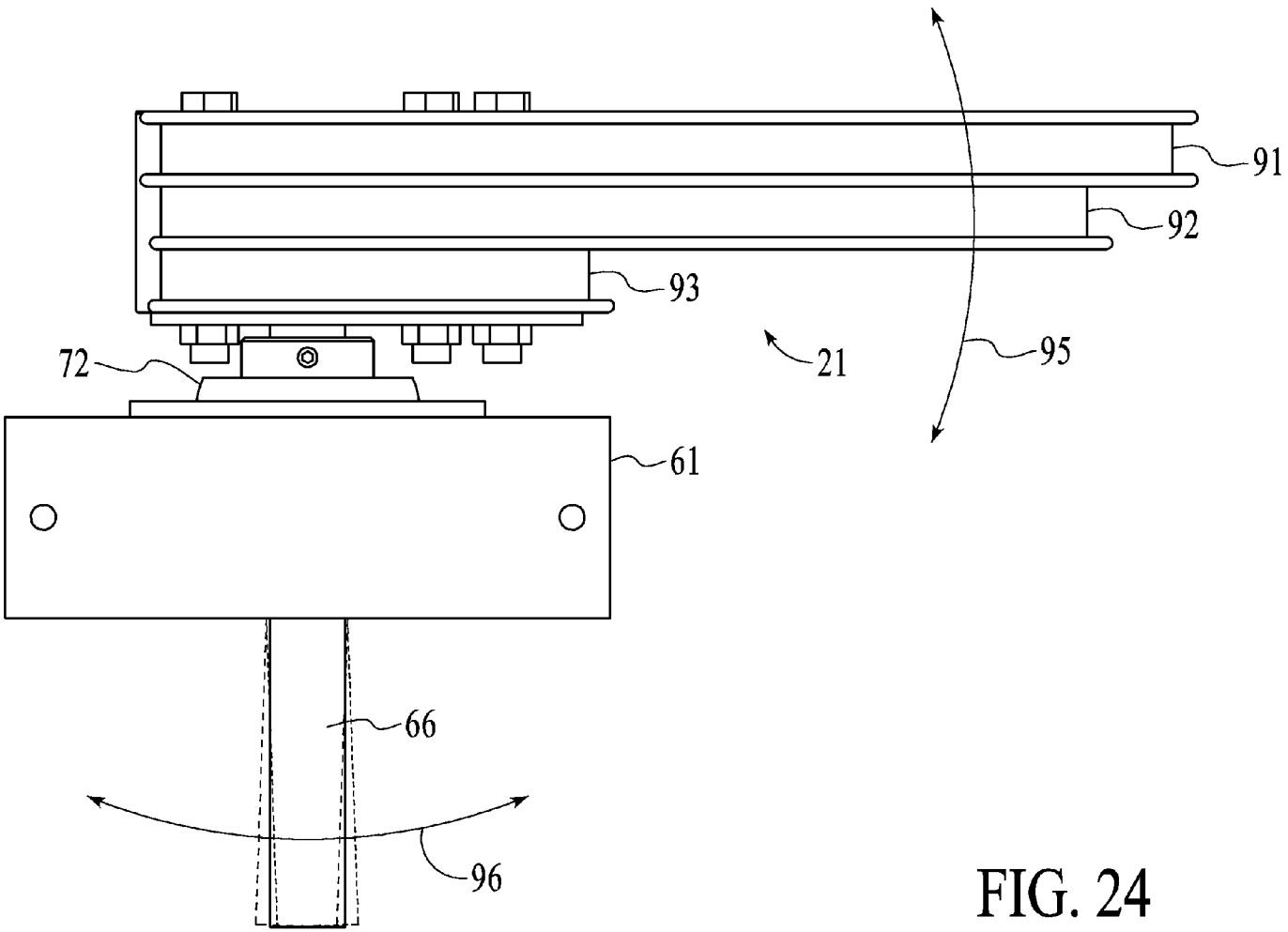
FIG. 24 shows more detail of a multi-tiered cam for the guide arm machine shown in FIG. 1 in accordance with an implementation.

FIG. 24 shows multi-tiered cam 21 mounted on housing 61 through a collar 72 in such a way that multi-tiered cam 21 and shaft 66 are able to be tilted (i.e., to rock) with respect to housing 61. This ability of multi-tiered 21 and shaft 66 ability to be tilted with respect to housing 61 is illustrated by arrows 95 and arrows 96. This ability of shaft to be tilted (rock) changes the angle of guide arm 20 with respect to adjustable main beam 33, thus allowing a batter to adjust swing plane during a swing. This allows versatility in the batter's swing. In general, whatever sports equipment items are used, the ability of multi-tiered 21 and shaft 66 ability to be tilted with respect to housing 61 allows an athlete to vary a plane of the motion path defined by rotation of the guide arm 20 around shaft 66

Figure 25:
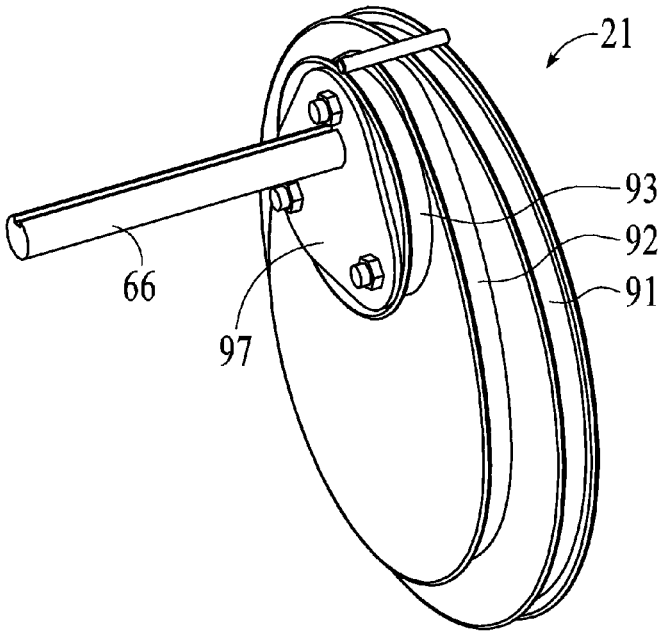
FIG. 25 shows more detail of the multi-tiered cam for the guide arm machine shown in FIG. 1 in accordance with an implementation.

FIG. 25 shows details of multi-tiered cam 21. Particularly a track 91, a track 92 and a track 93 are shown. The user can select which CAM supports cord 42 (shown in FIG. 5). The shape of each CAM provides varied resistance through motion. For example, the shown "pear" shape puts more resistance at the beginning of a swing. A smaller circumference, as in track 93, indicate less resistance. A larger circumference, as in trace 91 indicates greater resistance.

Figure 26:
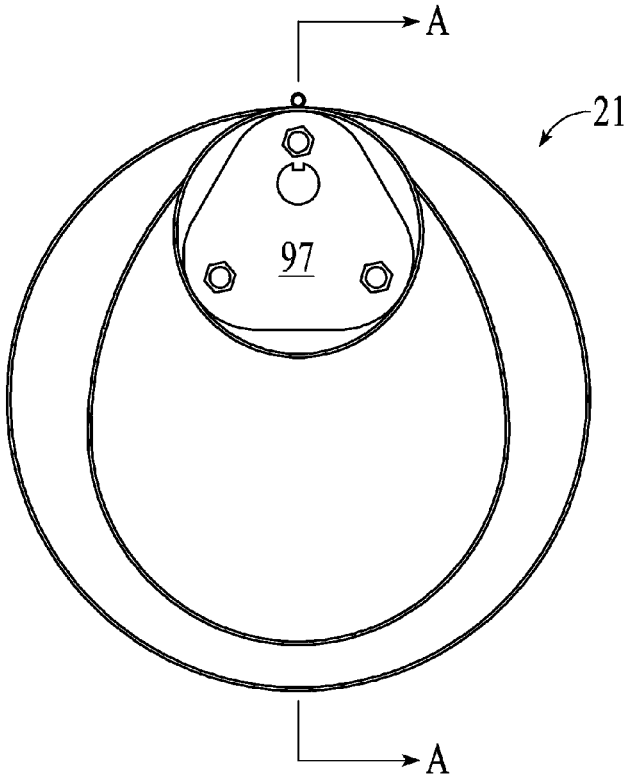
FIG. 26 shows more detail of the multi-tiered cam for the guide arm machine shown in FIG. 1 in accordance with an implementation.

FIG. 26 shows a perspective view of multi-tiered cam 21 emphasizing differences between track 91, track 92 and track 93. Shaft 66 is shown connected to multi-tiered cam 21 via a plate 97.

Figure 27:
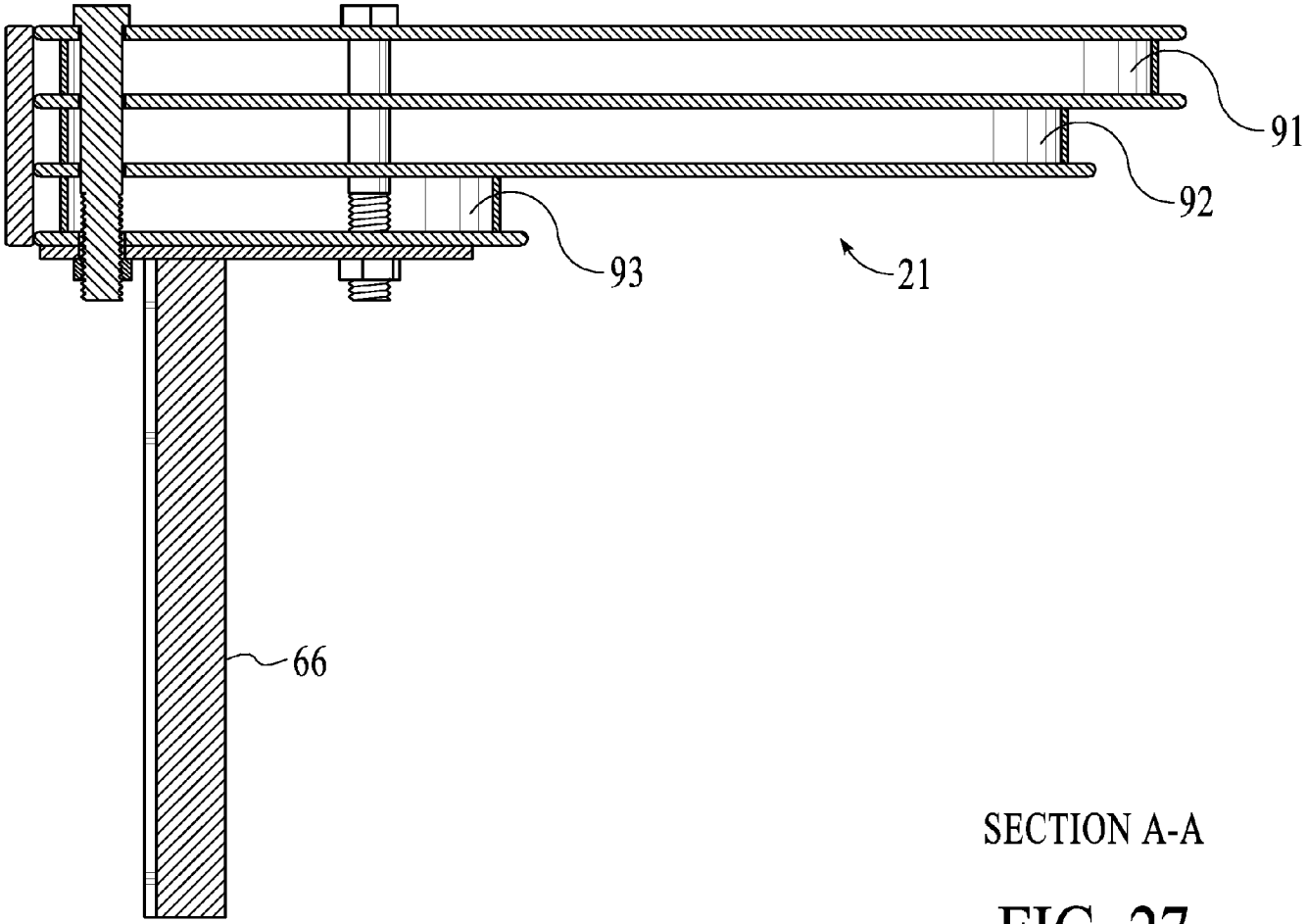
FIG. 27 shows more detail of the multi-tiered cam for the guide arm machine shown in FIG. 1 in accordance with an implementation.

FIG. 27 is a bottom view of multi-tiered cam 21, where size and shape differences between track 91, track 92 and track 93 are clearly seen.

Figure 28:
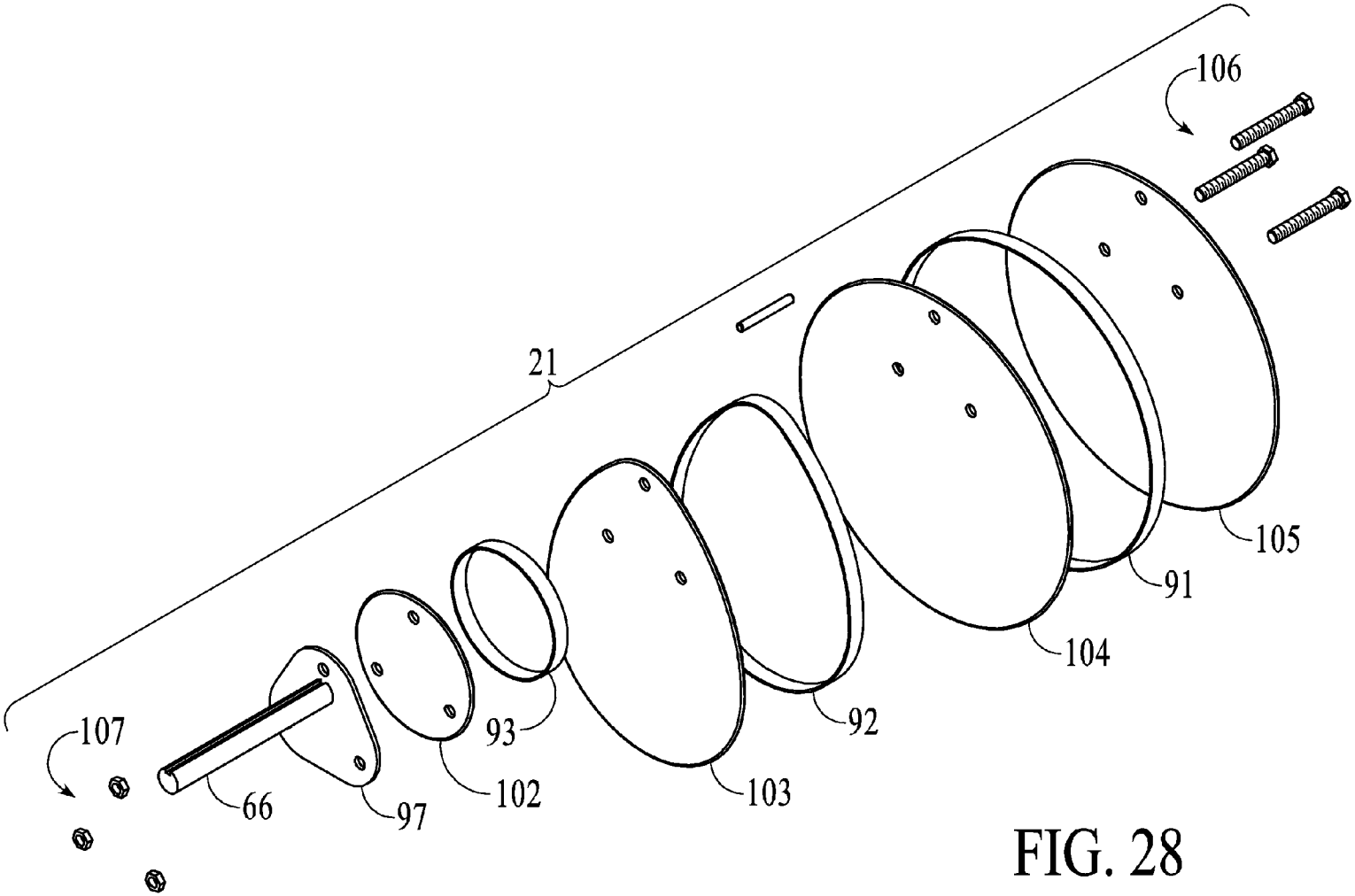
FIG. 28 is an exploded view of the multi-tiered cam for the guide arm machine shown in FIG. 1 in accordance with an implementation.

FIG. 28 is an exploded view of multi-tiered cam 21. Track 91 is arranged between a plate 104 and a plate 105. Track 92 is arranged between plate 104 and a plate 103. Track 93 is arranged between plate 103 and a plate 102. Plate 97 is attached to plate 102 via screws 106 and nuts 107.

Figure 29:
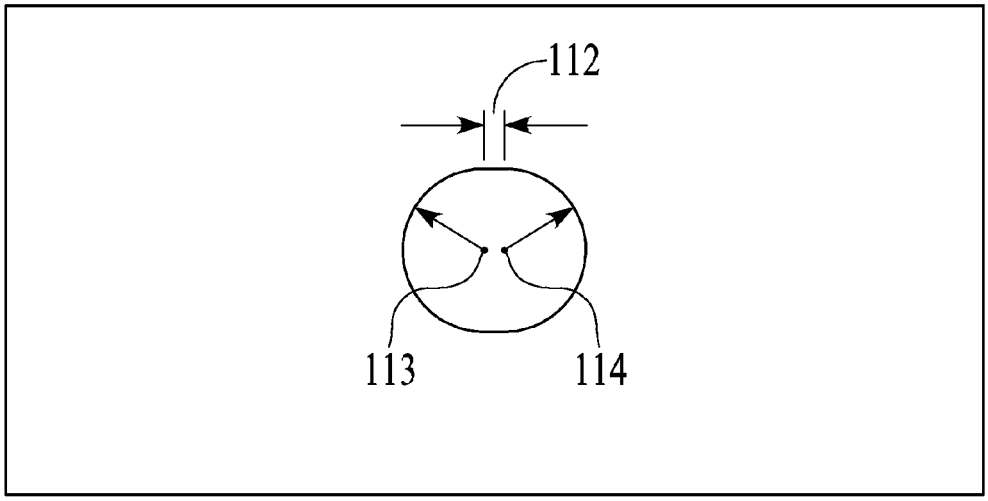
FIG. 29 shows more detail of the guide arm machine shown in FIG. 1 in accordance with an implementation.

As illustrated by FIG. 29, for a limiter in shaft housing, varying a distance 112 between a focus point 113 and a focus point 114 varies the shape of a hole that a shaft goes through.

Figure 30:
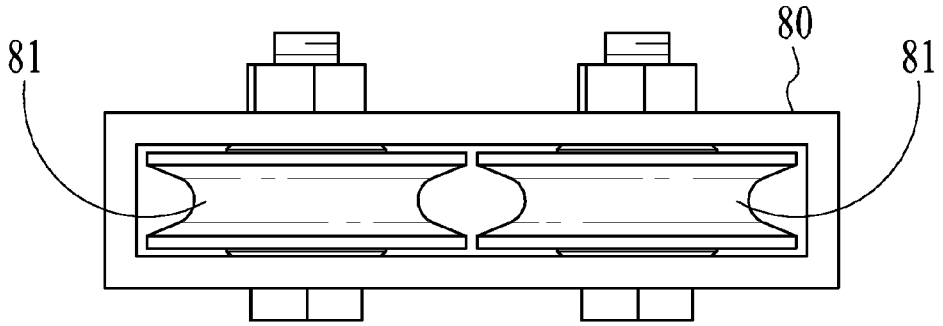
FIG. 30 shows more detail of pulley housing for the guide arm machine shown in FIG. 1 in accordance with an implementation.

FIG. 30 shows a side elevational view of dual pulley housing 80 including pulleys 81. Pulleys are used to keep cord 42 in line with the cam.

Figure 31:
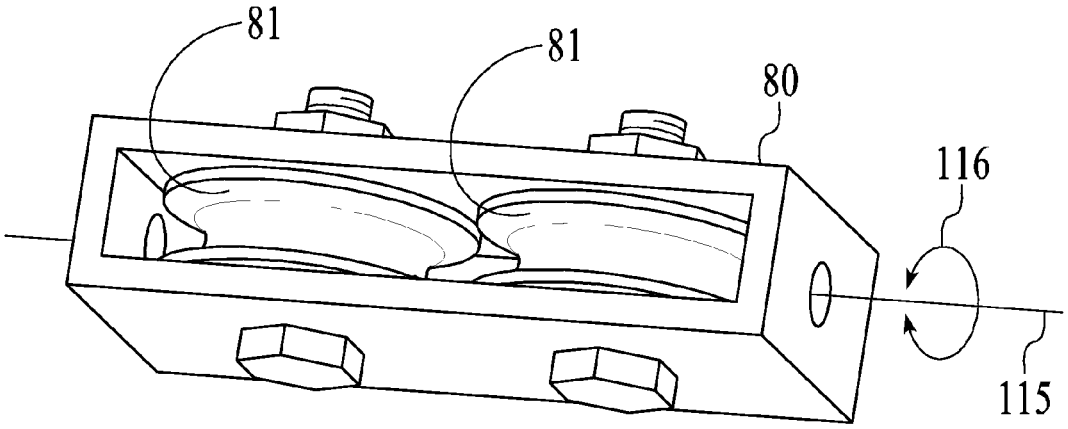
FIG. 31 shows more detail of pulley housing for the guide arm machine shown in FIG. 1 in accordance with an implementation.

FIG. 31 shows a perspective view of dual pulley housing 80 including pulleys 81. Dual pulley housing 80 is shown able to rotate around an axis 115, as illustrated by arrows 116. Dual pulley housing 80 keeps cord 40 in line with guide multi-tiered cam 21.

Figure 32:
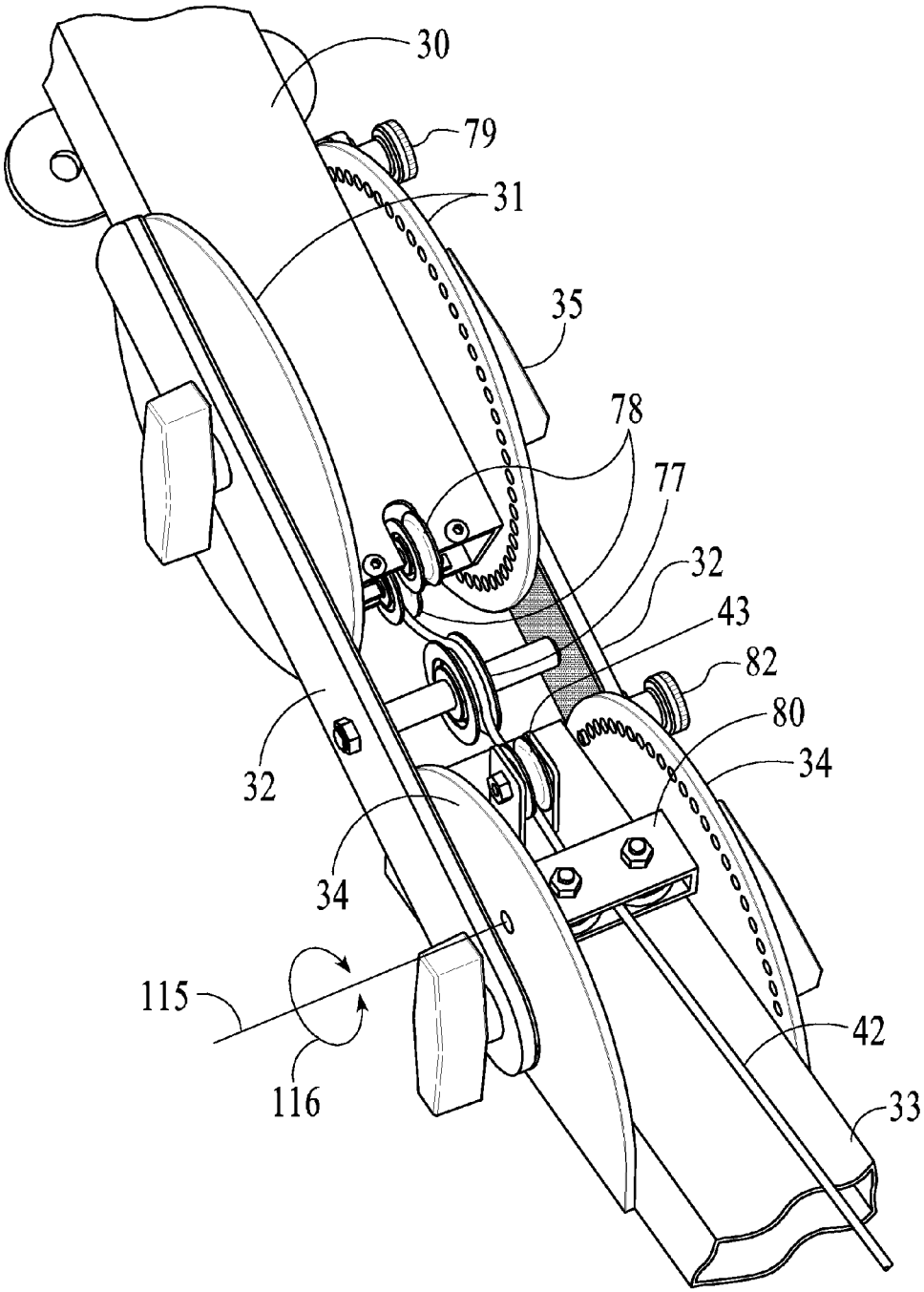
FIG. 32 shows more detail of a pulley system for the guide arm machine shown in FIG. 1 in accordance with an implementation.

FIG. 32 shows cord 42 arranged to traverse pulley 43, pulley 77 and pulleys 78 mounted on main frame beam 30.

Figure 33:
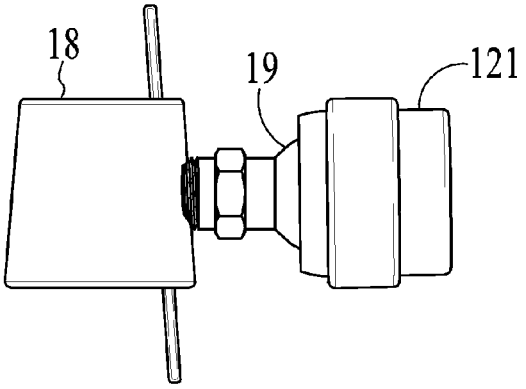
FIG. 33 shows more detail of a bat collar for the guide arm machine shown in FIG. 1 in accordance with an implementation.
Figure 34:
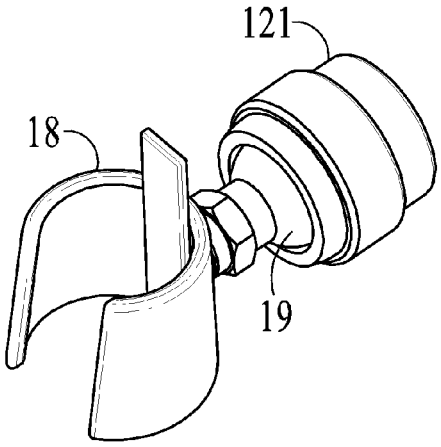
FIG. 34 shows more detail of a bat collar for the guide arm machine shown in FIG. 1 in accordance with an implementation.
Figure 35:
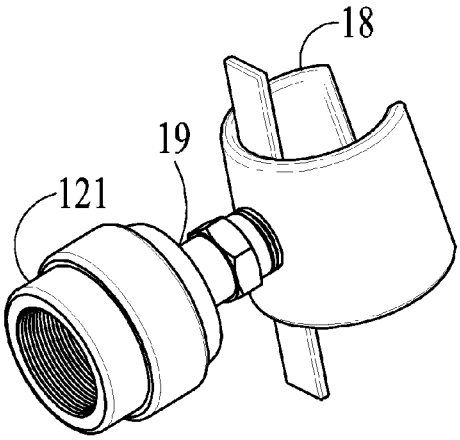
FIG. 35 shows more detail of a bat collar for the guide arm machine shown in FIG. 1 in accordance with an implementation.
Figure 36:
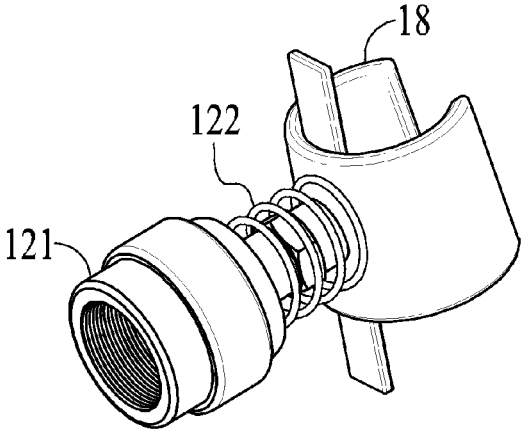
FIG. 36 shows more detail of a bat collar for the guide arm machine shown in FIG. 1 in accordance with an implementation.

FIGS. 33 through 36 show various views of bat collar 18. FIG. 33 is an elevational view of bat collar 18 connected to a screwed socket 121 via universal joint 19. FIG. 34 is an elevational view of bat collar 18 connected to screwed socket 121 via universal joint 19. FIG. 35 is another elevational view of bat collar 18 connected to screwed socket 121 via universal joint 19. FIG. 36 is an elevational view of bat collar 18 connected to screwed socket 121 via universal joint 19, including a spring 122 placed as shown. Spring 122 adds resistance during movement of guide arm 20.

Figure 37:
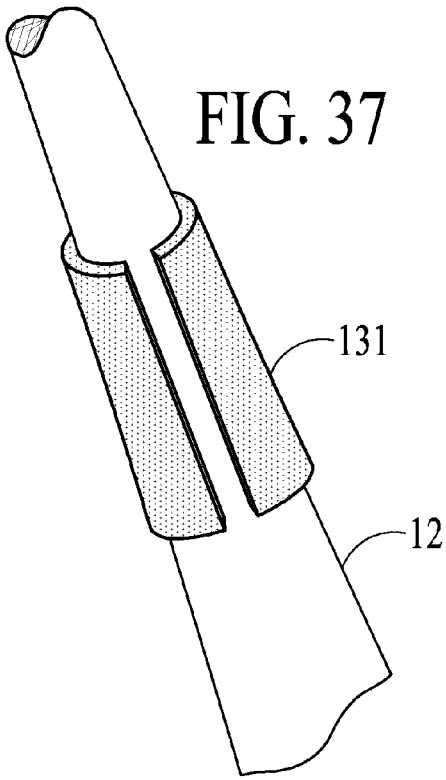
FIG. 37 shows more detail of a bat collar arranged to hold a bat in accordance with an implementation.
Figure 38:
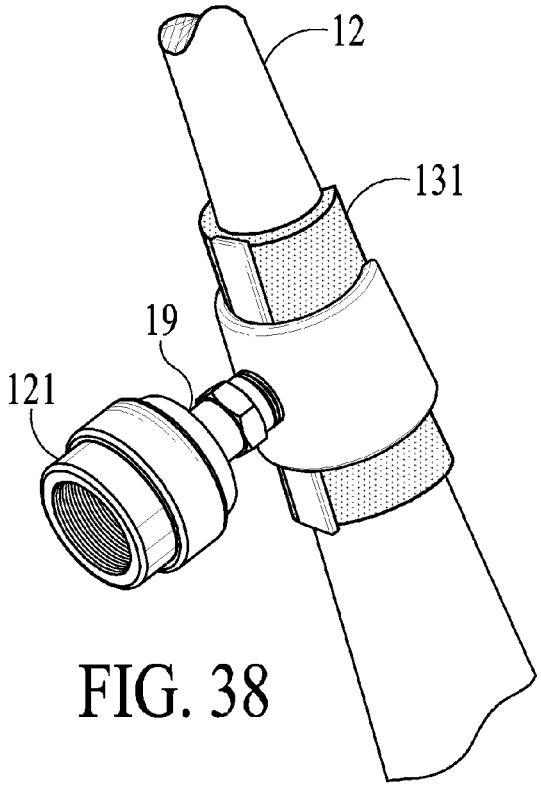
FIG. 38 shows more detail of a bat collar arranged to hold a bat in accordance with an implementation.
Figure 39:
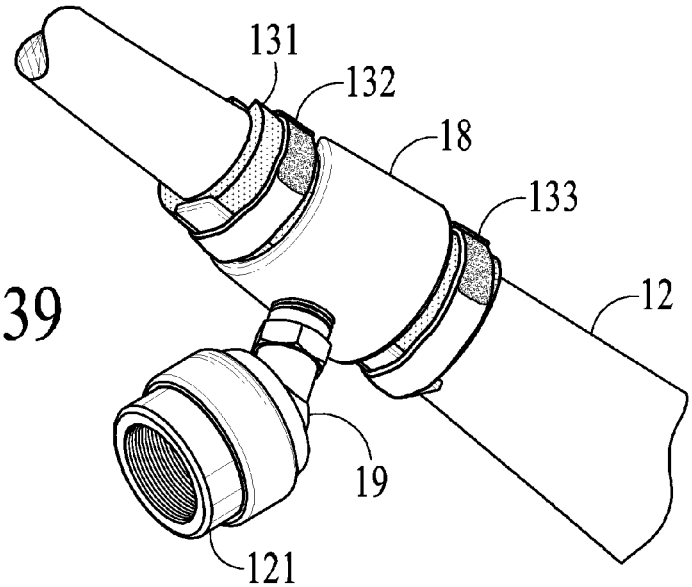
FIG. 39 shows more detail of a bat collar arranged to hold a bat in accordance with an implementation.

FIG. 37 shows padding 131 placed over bat 12. FIG. 38 shows bat 12 at padding 131 placed within bat collar 18. FIG. 39 shows straps 132 securing bat 12 and padding 131 in place within bat collar 18. In FIG. 39, the angle of universal joint 19 to screwed socket 121 is adjusted as compared to the angle of universal joint 19 to screwed socket 121 shown in FIG. 38.

Figure 40:
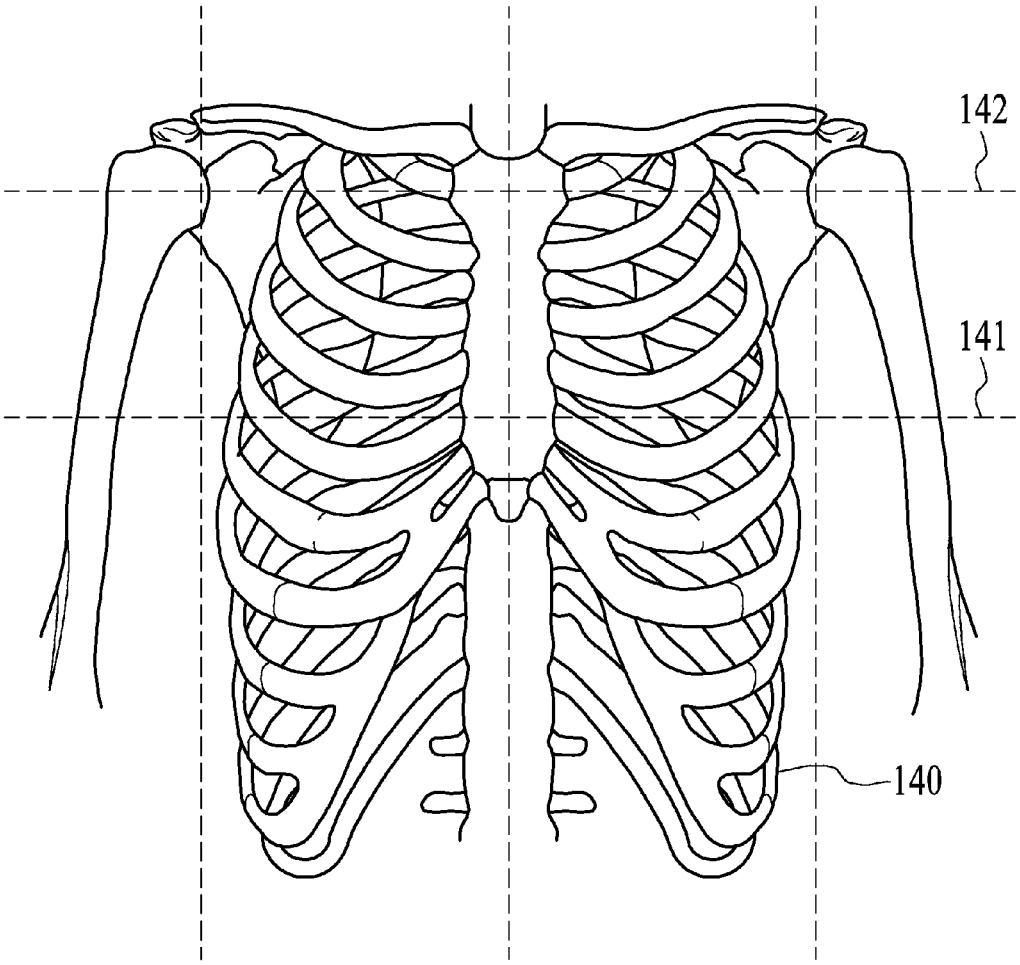
FIG. 40 shows axes of rotation in relation to a rib cage.

FIG. 40 shows an axis 141 and an axis 142 juxtaposed on a rib cage. Location of axis 141 and axis 142 on a user impacts adjustments made to guide arm machine 10 to insure that guide arm machine 10 guides along a proper swing plane for the user.

Figure 41:
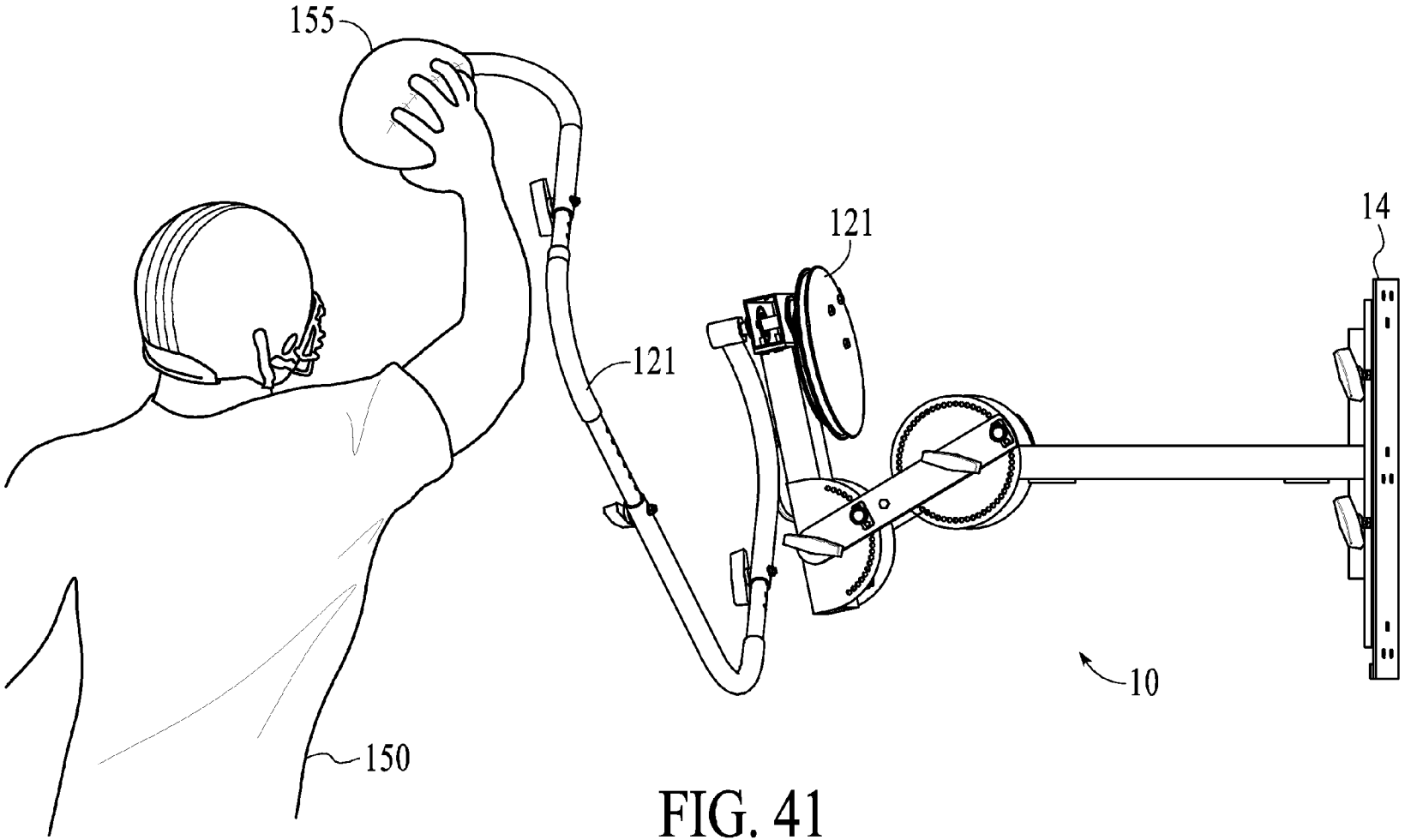
FIG. 41 shows a guide arm machine being used to aid a football player to groove an efficient throwing motion in accordance with an implementation.

FIG. 41 shows a football player 150 using guide arm machine 10 to groove an efficient throwing motion. A football 155 is attached to guide arm 20. Multi-tiered cam 21 allows motion of football 155 in a desired path. Guide arm machine 10 is attached to a wall using a wall mount 14.

Figure 42:
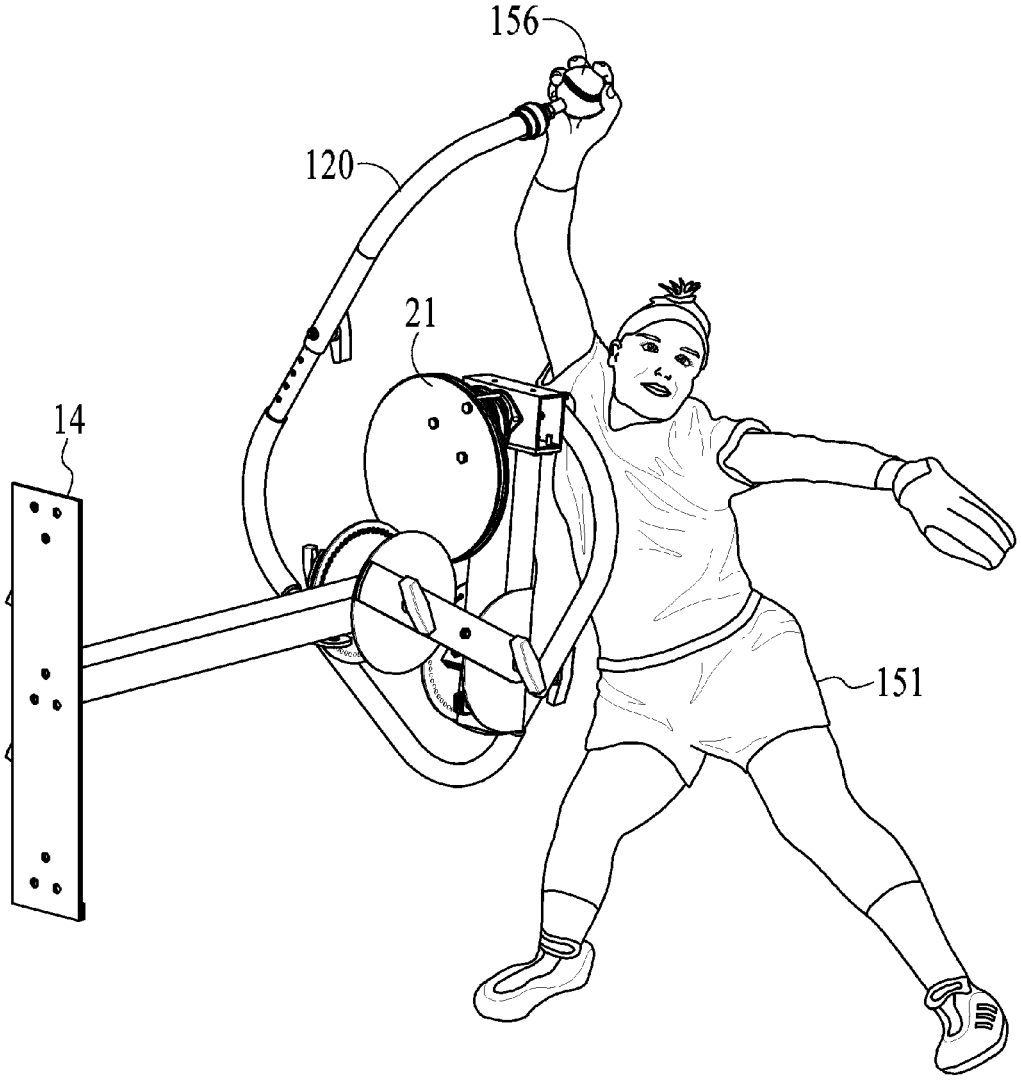
FIG. 42 shows a guide arm machine being used to aid a softball player to groove an efficient pitching motion in accordance with an implementation.

FIG. 42 shows a softball player 151 using guide arm machine 10 to groove an efficient pitching motion. A softball 156 is attached to guide arm 20. Multi-tiered cam 21 allows motion of softball 156 in a desired path. Additionally, an appropriate attachment allows work on ball spin within the pitching motion.

Figure 43:
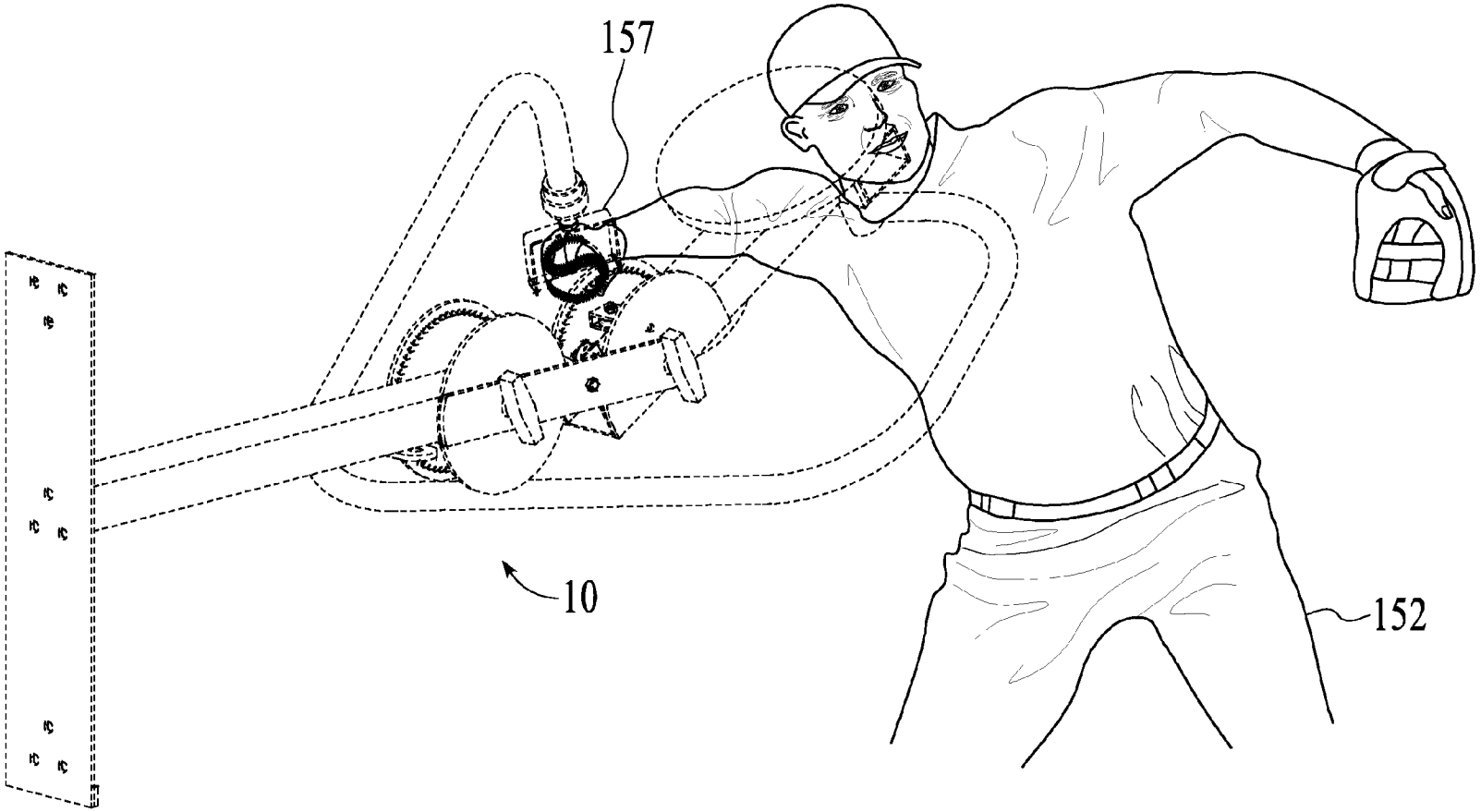
FIG. 43 shows a guide arm machine being used to aid a baseball player to groove an efficient throwing motion in accordance with an implementation.

FIG. 43 shows a baseball player 152 using guide arm machine 10 to groove an efficient throwing motion. A baseball 157 is attached to guide arm 20. Multi-tiered cam 21 allows motion of baseball 157 in a desired path.

Figure 44:
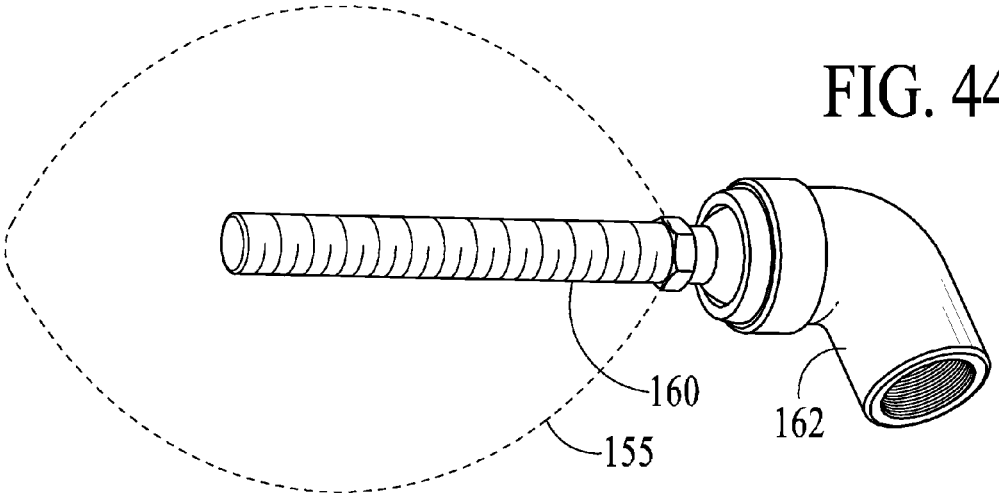
FIG. 44 shows more detail of an equipment holder for the guide arm machine shown in FIG. 41 in accordance with an implementation.

FIG. 44 shows a shaft 160 on which football 155 may be mounted. Shaft 160 is attached to a threaded socket 162 via a universal joint.

Figure 45:
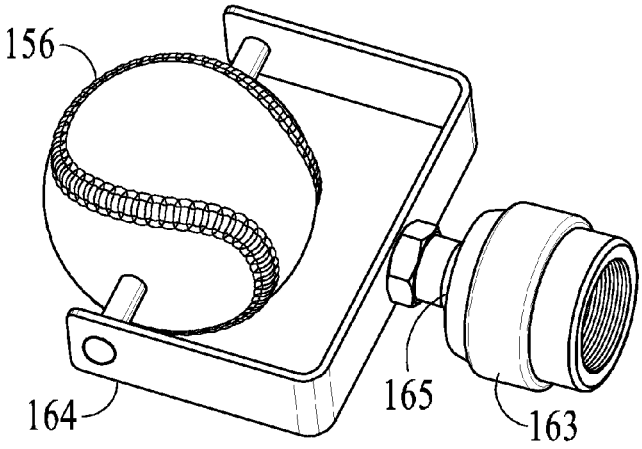
FIG. 45 shows more detail of an equipment holder for the guide arm machine shown in FIG. 43 in accordance with an implementation.

FIG. 45 shows a frame 164 on which baseball 156 is mounted. Frame 164 is attached to a threaded socket 163 via a universal joint 165.

Figure 46:
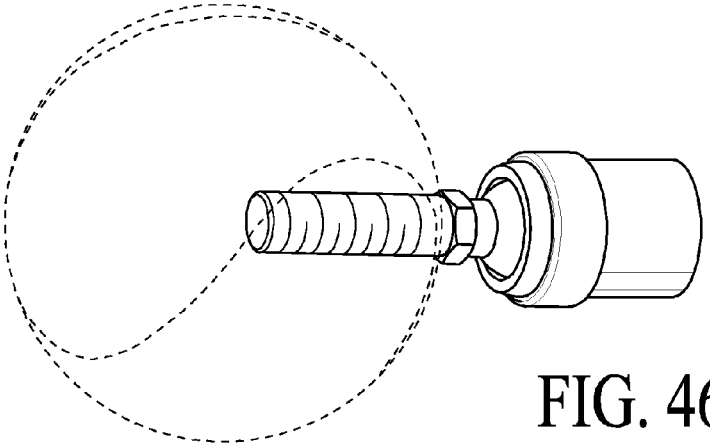
FIG. 46 shows more detail of an equipment holder for the guide arm machine shown in FIG. 42 in accordance with an implementation.

FIG. 46 shows more detail for the guide arm machine shown in FIG. 42.

The different equipment collars allow guide arm machine 10 to be used for a variety of sports and sports motions. For example, with a collar adapted to hold a golf club, guide arm machine 10 can be configured to guide a golfer through an optimal golf swing plane. Resistance can be added to motion of the guide arm machine in order to not only guide motion but to strengthen muscles that carry out the motion.

Guide arm machine 10 can be used in tandem with sensors that provide feedback such as audio feedback, visual feedback, tactile feedback and olfactory feedback. Adjustable speeds and full motion movements of guide arm machine 10 and sensors. In addition, other measurement can be made, before during or after use of guide arm machine 10. These can include, for example, measurements of muscles reactionary speed, blood flow, heart rate, breathing capacity, range of exercise motion, reactionary time, applied exercise power capacity and so on. These measurements can help to optimize exercise motion. Video recording of operation, including complete 360 degrees video monitoring and recording can be used during sessions using guide arm system 10. Medical uses of guide arm system 10 can include physical therapy sessions with varied resistance using small space confined exercise equipment and rehabilitation for torn muscles, ligaments, nerve damage, broken bones or joints. Actual human interaction strengthening processes can be recorded. Recorded user data can be centrally stored and available for download at an internet connection spot or a docking station located near guide arm machine 10.

For example, a "four-dimensional" graphical user interface employing real-time texture mapping can be use with guide arm machine 10. For example, a user selects a number of machines to be displayed. Each selected machine is then texture mapped to a polygonal surface. The surfaces are displayed at orientations to form a polyhedron with a machine on each face. Each face may be translucent, so that work out sessions otherwise hidden are visible. The polyhedron rotates under the user's control so that each users face is presented to the user. It is this combination of a three-dimensional figure with real-time rotation and texture mapping that makes the graphical user interface "four-dimensional".

The graphical user interface can receive input from various means such as, but not limited to, through a trackball, joystick, pointing stick, mouse, other pointing devices, moving sensors, remote control, baseball bat monitoring, hockey stick monitoring, golf club monitoring, virtual keyboard and drones that fly, move on tracks or are suspended on wires.

Human-computer interaction (HCI) involves the study, planning, and design of the interaction between people (users) and computers. It is often regarded as the intersection of computer science, behavioral sciences, interaction design. This list includes Interactive technologies. HCI can include, for example, heart rate monitoring, blood sampling, brain monitor sensing, live muscle sensing, internal and external tendon sensors, visual, eye sensors, monitor and visual lenses over the eye for monitoring and visual screen modification. Use of guide arm machine 10 can be enhanced, for example, by implementing predictive models of human to computer interaction, implementing multiple interfaces to show progress or visual results after a work out session and implementing processes for interfaces. For example, when guide arm machine 10 is utilized with bat 12, input and output goals and conditions for each individual user can be set by an associated computing device. Feedback from the computing device can aid in evaluating, moderating and confirming guide arm machine 10 is operating or making changes per the individuals work out results.

Measurements can be empirical and iterative. After determining the users, tasks, and empirical measurements of exercises, iterative design steps can include, for example: (1) Design the user interface, (2) Test for results—connect sensors, (3) Analyze test results, (4) Repeat a work out.

Guide arm machine 10, connected to bat 12 can be connected to Fiber Optic Interface spectrometer to fiber optic transmission cells, probes and sensors. This includes digital interface controllers and modules for future data transfer. Optical telemetry can be used for transcutaneous data transfer. For example, this could be used with robotic arms, legs, or other body components. CORTICAL interfacing is used for the rehabilitation of the mobility impaired, among other applications. This includes real-time control of computer cursors or robotic arms that control the actuation of recorded neural signals which can be sent to the user's brain or muscle or nerve control centers. Optics with the full range of light spectrum can be used for the visual interaction portion of guide arm machine 10. For example, an optics system such as an optics transceiver Cisco Compliant XFP-10G-MM-SR 10GBASE-SR XFP Module can be used.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A guide arm machine, comprising:

a guide arm;

an equipment holder attached to the guide arm, the equipment holder being optimized to hold a sports equipment item;

a shaft, the guide arm being attached to the shaft, so that the shaft defines a rotation axis around which the guide arm rotates;

a housing which anchors the shaft;

a frame including tracks, the housing sliding along the tracks so that the rotation axis moves with respect to the frame but not with respect to the housing;

an adjustable main beam whose position is adjustable with respect to a stationary anchor, the adjustable main beam supporting the frame so that when the sports equipment item is held by the equipment holder and a position of the adjustable main beam is appropriately adjusted, movement of the guide arm guides an athlete holding the equipment holder item into a desired motion that trains the athlete in efficient use of the sports equipment item, rotation of the guide arm around the shaft defining a motion path of the sports equipment and changing of position of the housing within the frame allowing the athlete to vary the motion path defined by rotation of the guide arm around the shaft.

2. A guide arm machine as in claim 1 wherein, the equipment holder is attached to the guide arm via a universal joint that allows the athlete to adjust position of the sports equipment item with respect to the guide arm.

3. A guide arm machine as in claim 1 wherein the stationary anchor is a wall, the guide arm machine additionally comprising:

a main frame beam attached to the wall;

lever adjusters attached to the main frame beam and the adjustable main beam wherein an angle of attachment between the main frame beam and the lever adjusters is adjustable and an angle of angle of attachment between the adjustable main beam and the lever adjusters is adjustable, allowing adjustment of position of the adjustable main beam with respect to the wall.

4. A guide arm machine as in claim 1, additionally comprising:

a main frame beam attached to the stationary anchor;

lever adjusters attached to the main frame beam and the adjustable main beam wherein an angle of attachment between the main frame beam and the lever adjusters is adjustable and an angle of attachment between the adjustable main beam and the lever adjusters is adjustable, allowing adjustment of position of the adjustable main beam with respect to the stationary anchor.

5. A guide arm machine as in claim 1 wherein the housing anchors the shaft so that a shaft angle with respect to the housing can be tilted, allowing the athlete to vary a plane of the motion path defined by rotation of the guide arm around the shaft.

6. A guide arm machine as in claim 1 wherein the equipment holder is a bat collar and the sports equipment item is a bat.

7. A guide arm machine as in claim 1 wherein the equipment item is a ball and the motion path defines a path for throwing the ball.

8. A guide arm machine as in claim 1 wherein the sports equipment item is a golf club.

9. A guide arm machine as in claim 1 wherein the adjustable main beam supports the frame so that a direction which the housing slides along the tracks is lengthwise with respect to the adjustable main beam.

10. A guide arm machine as in claim 1 wherein the adjustable main beam supports the frame so that a direction which the housing slides along the tracks is perpendicular to lengthwise with respect to the adjustable main beam.

11. A guide arm machine, comprising:

a guide arm;

an equipment holder attached to the guide arm, the equipment holder being optimized to hold a sports equipment item, wherein the equipment holder is attached to the guide arm via a universal joint that allows an athlete to adjust position of the sports equipment item with respect to the guide arm;

a shaft, the guide arm being attached to the shaft, so that the shaft defines a rotation axis around which the guide arm rotates;

a housing which anchors the shaft;

an adjustable main beam whose position is adjustable with respect to a stationary anchor, the adjustable main beam supporting the housing so that when the sports equipment item is held by the equipment holder and a position of the adjustable main beam is appropriately adjusted, rotation of the guide arm around the guide arm guides an athlete holding the equipment holder item into a desired motion that trains the athlete in efficient use of the sports equipment item, rotation of the guide arm around the shaft defining a motion path of the sports equipment.

12. A guide arm machine as in claim 11 wherein the stationary anchor is a wall, the guide arm machine additionally comprising:

a main frame beam attached to the wall;

lever adjusters attached to the main frame beam and the adjustable main beam wherein an angle of attachment between the main frame beam and the lever adjusters is adjustable and an angle of angle of attachment between the adjustable main beam and the lever adjusters is adjustable, allowing adjustment of position of the adjustable main beam with respect to the wall.

13. A guide arm machine as in claim 11, additionally comprising:

a main frame beam attached to the stationary anchor;

lever adjusters attached to the main frame beam and the adjustable main beam wherein an angle of attachment between the main frame beam and the lever adjusters is adjustable and an angle of attachment between the adjustable main beam and the lever adjusters is adjustable, allowing adjustment of position of the adjustable main beam with respect to the stationary anchor.

14. A guide arm machine as in claim 11 wherein the housing anchors the shaft so that a shaft angle with respect to the housing can be tilted, allowing the athlete to vary a plane of the motion path defined by rotation of the guide arm around the shaft.

15. A guide arm as in claim 11 wherein the equipment holder is a bat collar and the sports equipment item is a bat.

16. A guide arm as in claim 11 wherein the equipment item is a ball and the motion path defines a path for throwing the ball.

17. A guide arm as in claim 11 wherein the sports equipment item is a golf club.

18. A guide arm machine, comprising:

a guide arm;

an equipment holder attached to the guide arm, the equipment holder being optimized to hold a sports equipment item;

a shaft, the guide arm being attached to the shaft, so that the shaft defines a rotation axis around which the guide arm rotates;

a housing which anchors the shaft;

an adjustable main beam whose position is adjustable with respect to a stationary anchor, the adjustable main beam supporting the housing so that when the sports equipment item is held by the equipment holder and a position of the adjustable main beam is appropriately adjusted, rotation of the guide arm around the guide arm guides an athlete holding the equipment holder item into a desired motion that trains the athlete in efficient use of the sports equipment item, rotation of the guide arm around the shaft defining a motion path of the sports equipment;

wherein the housing anchors the shaft so that a shaft angle with respect to the housing can be tilted, allowing the athlete to vary a plane of the motion path defined by rotation of the guide arm around the shaft.

19. A guide arm machine as in claim 18 wherein the stationary anchor is a wall, the guide arm machine additionally comprising:

a main frame beam attached to the wall;

lever adjusters attached to the main frame beam and the adjustable main beam wherein an angle of attachment between the main frame beam and the lever adjusters is adjustable and an angle of angle of attachment between the adjustable main beam and the lever adjusters is adjustable, allowing adjustment of position of the adjustable main beam with respect to the wall.

20. A guide arm machine as in claim 18, additionally comprising:

a main frame beam attached to the stationary anchor;

lever adjusters attached to the main frame beam and the adjustable main beam wherein an angle of attachment between the main frame beam and the lever adjusters is adjustable and an angle of attachment between the adjustable main beam and the lever adjusters is adjustable, allowing adjustment of position of the adjustable main beam with respect to the stationary anchor.

* * * * *